United States Patent [19]

Nishikawa

[11] 4,379,384

[45] Apr. 12, 1983

[54] METHOD AND APPARATUS FOR AUTOMATICALLY PACKAGING STOCKINGS

[75] Inventor: Masao Nishikawa, Nara, Japan

[73] Assignee: Takatori Machinery Works Ltd., Japan

[21] Appl. No.: 185,630

[22] Filed: Sep. 10, 1980

[30] Foreign Application Priority Data

| | | | |
|---|---|---|---|
| Sep. 12, 1979 | [JP] | Japan | 54-117585 |
| Oct. 11, 1979 | [JP] | Japan | 54-132213 |
| Jun. 7, 1980 | [JP] | Japan | 55-76937 |

[51] Int. Cl.[3] ..... B65B 9/08; B65B 63/04

[52] U.S. Cl. ..... 53/415; 53/429; 53/459; 53/474; 53/117; 53/156; 53/569

[58] Field of Search ..... 53/429, 474, 117, 156, 53/238, 568, 569, 266 A, 415, 459, 469, 137; 493/409, 450, 965

[56] References Cited

U.S. PATENT DOCUMENTS

| | | | |
|---|---|---|---|
| 3,019,572 | 2/1962 | Berry | 53/429 |
| 3,152,800 | 10/1964 | Hanson | 493/409 |
| 3,310,930 | 3/1967 | Korch | 53/117 |
| 3,410,053 | 11/1968 | Bonsch | 53/266 A |
| 3,514,019 | 5/1970 | Glaze, Jr. | 53/117 X |
| 3,727,373 | 4/1973 | MacLeod | 53/568 |
| 3,742,676 | 7/1973 | Lawing | 53/117 X |
| 3,750,916 | 8/1973 | Stringer | 53/117 X |
| 3,768,226 | 10/1973 | Glaze, Jr. | 53/117 X |

FOREIGN PATENT DOCUMENTS

| | | | |
|---|---|---|---|
| 297329 | 6/1932 | Italy | 493/409 |
| 181800 | 12/1962 | Sweden | 493/409 |

*Primary Examiner*—John Sipos

*Attorney, Agent, or Firm*—Lerner, David, Littenberg & Samuel

[57] ABSTRACT

A fully automatic system for folding stockings or a like long, substantially flat, non-rigid article around a cardboard insert, including foldable insert, and enclosing the stockings with the insert in an envelope of transparent, thermoplastic material. A great deal of saving of manual labor enables ideal streamlining of the whole process for manufacturing stockings for remarkable reduction in manufacturing cost. Sealing of the envelope containing the stockings with gummed tapes may be performed fully automatically, also.

12 Claims, 54 Drawing Figures

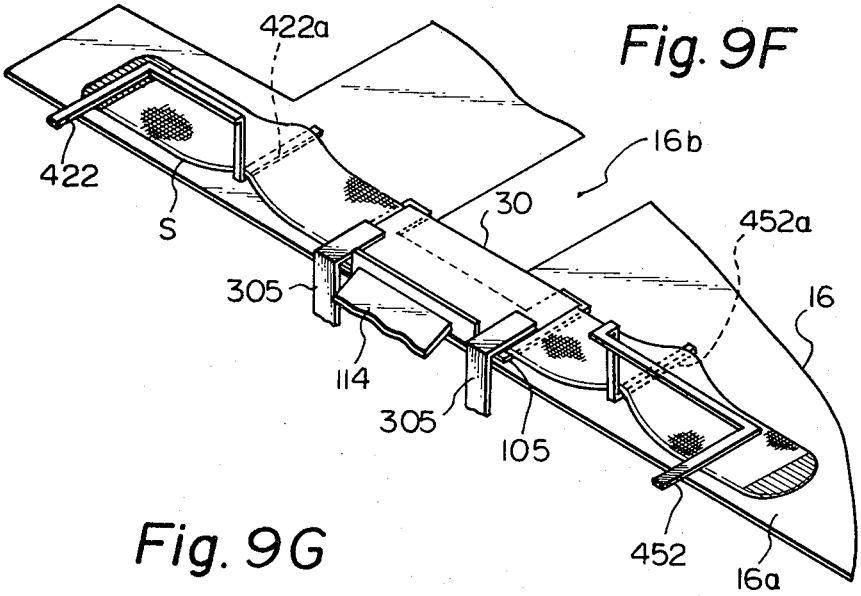
Fig. 9F
Fig. 9G
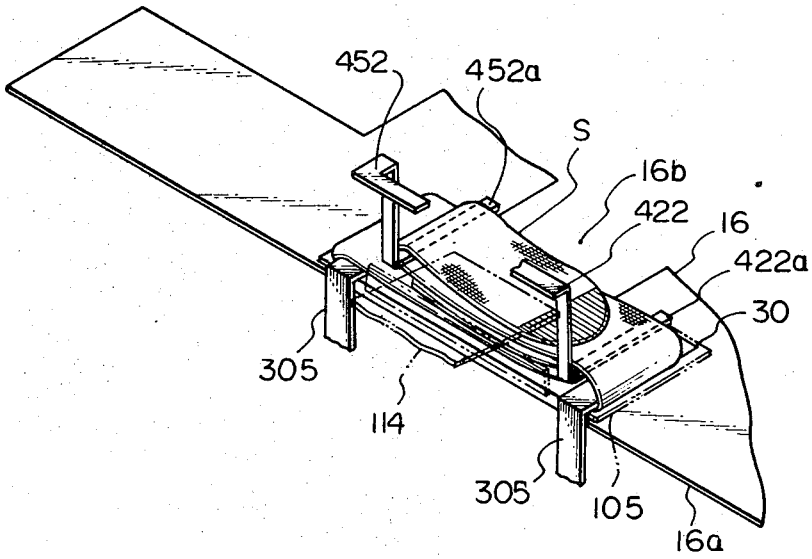

METHOD AND APPARATUS FOR AUTOMATICALLY PACKAGING STOCKINGS

BACKGROUND OF THE INVENTION

The present invention relates to method and apparatus for automatically packaging stockings, and more particularly to a fully automatic system for enclosing stockings, such as seamless stockings and panty-hoses, folded around a cardboard insert in an envelope of transparent, thermoplastic material.

Although the following descriptions are focussed upon application of the present invention to stockings only, the present invention is more generally applicable to packaging of substantially flat, relatively long, non-rigid and foldable articles.

Reverting to the application to stockings, one cycle of packaging process roughly includes the step of placing stockings in position on an operating station, the step of feeding an insert in position on the stockings so placed, the step of provisionally fixing the position of the insert relative to the stockings, the step of folding the stockings around the insert, the step of feeding an envelope to a prescribed stand-by position with its mouth open, the step of conveying the stockings folded around the insert to a prescribed position in line with the envelope in the stand-by position, the step of enclosing the stockings with the insert in the envelope, and the step of sealing the envelope.

Several systems have been proposed in order to achieve such an automatic packaging of stockings, but they are all common in their basic operational construction. First, each system includes a plurality of folding steps. Secondly, these folding operations have to be carried out during transportation of stockings. These naturally causes complicated mechanical construction of the apparatus and naturally difficulty in maintenance and adjustment, thereby raising production cost greatly.

When folding is to be carried out concurrently with transportation of stockings, it is necessary to compulsorily feed the stocking into a nip or nips formed by at least a pair of conveyer belts or slide rollers in pressure contact and such strong nip tend to develop defects such as distortion, thereby seriously damaging commercial value of stockings which generally require fine, soft and smooth touch.

For these reasons, stockings have conventionally been mostly packaged by manual operation. Even in a better case, stockings have to be folded around an insert by manual operation before supply to an automatic packaging machine as a typical example is disclosed by Japanese Patent Publication No. Sho. 50-22477.

In anyway, at least the first four steps of the abovedescribed one cycle of packaging process have to depend upon manual operation, which naturally leads to inevitable rise in labour cost. Further, the relatively low production efficiency in the packaging process caused by inclusion of large ratio of manual labour forms a serious bottleneck in stream lining the entire, continuous production system of stockings. Thus, reduction in manaual labour in packaging process has in particular been desired by producers of stockings.

An insert to be folded around by stockings is not limited to a flat one. That is, a foldable insert is made up of a back cover section, a front cover section and an insert section bordered by two bending edges. The insert section is folded around by the stockings as an ordinary insert, the back cover section covers the back side of the stockings folded around the insert section, and the front cover section covers the front side of the stockings folded around the insert section and is usually accompanied with advertising or other descriptive representations.

When such a foldable insert is used, the insert has to be once flattened, or opened, prior to being placed in position on stockings. Next, such an open insert has to be placed on the stockings so that its insert section is placed about middle of the stockings. After the correct placement is complete, the stockings are folded around the insert section of the foldable insert as in the case of an ordinary flat insert. Finally, the front and back cover sections have to be folded around the stockings which have already been folded around the insert section.

Due to the complication of the work, the process has to be generally carried out by manual labour only which requires high technique and time consumption. Consequently, use of foldable inserts conventionally seriously hindered full automization of the stockings packaging process, and greatly lowered overall efficiency of the process, too.

The low process efficiency in packaging stockings has also been caused by manual sealing of an envelope enclosing folded stockings with an insert.

After the stockings are enclosed in the envelope, its mouth is still left open and its flap still remain flat. In order to seal the envelope, an operator needs to fold over the flap and apply one or more gummed tapes which hold the flap down. Further, requirement for correct positioning of the tapes and extremely frequent repetition of the work caused increased fatigue of the operators and difficulty in long, continuous service.

Process efficiency in automatic stockings packaging is greatly swayed by the type of the pattern of stockings folded around an insert. After the folding, the stockings with the insert have to be enclosed in an envelope placed in the stand-by position with its mouth open.

In the conventional type, the toe or waist end is exposed outside the stockings in the folded state. That is, the uppermost layer of the folded body always includes either of the toe and waist ends. Presence of such an end on the upper most layer often disables smooth entrance of the folded stockings into the envelope through its open mouth, and naturally enclosing ends in failure.

SUMMARY OF THE INVENTION

It is the primary object of the present invention to provide method and apparatus for carrying out, in packaging of stockings, at least the steps from placing stockings in position on an operating station to enclosing the stockings with an insert in an envelope, in a fully automatic fashion.

It is another object of the present invention to provide method and apparatus for automatically packaging stockings whilst using foldable cardboard insert composed of three sections bordered by bending edges.

It is the other object of the present invention to provide method and apparatus for carrying out, in packaging of stockings, the entire steps from placing stockings in position on an operating station to sealing an envelope which encloses stockings folded around a cardboard insert.

It is a further object of the present invention to provide method and apparatus, in automatic packaging of stockings, for folding stockings around an insert without any end exposed outside.

It is a still further object of the present invention to provide method and apparatus for automatically packaging stockings at high production efficiency and without any damage on the quality of the stockings.

In accordance with the basic concept of the prsent invention, the automatic method comprises the step of placing individual stockings, fed from a given source, under tension in position on an operating station; the step of feeding an insert of a given pattern to about the middle of the stockings placed on the operating station; the step of provisionall fixing the position of the insert relative to the stockings; the step of folding waist and toe end sections of the stockings around the insert in the provisionally fixed state, one over another; the step of feeding an envelope having a flap at its open end to a prescribed stand-by position with its mouth open; the step of conveying the stockings folded around the insert to a prescribed position in line with the envelope in the above-described stand-by position; and the step of enclosing the stockings with the insert in the envelope through the open mouth.

The insert is in general made of a cardboard and given in the form of a flat card or a foldable card made of three sections bordered by bending edges, one section being provided with an advertising or other descriptive design.

The automatic method may additionally include the step of feeding individual stockings sequentially from a given source wherein the stockings are reversed in a pile.

The automatic method may further include the step of sealing the envelope containing the folded stockings with at least a gummed tape.

In accordance with the basic concept of the present invention, the automatic apparatus includes a setting station chosen about the front middle of an operation table mounted atop the pedestal of the apparatus; a transfer assembly arranged on the table facing the setting station and for transferring individual stockings fed from a given source to the setting station; an insert feeder assembly arranged facing the setting station and for feeding individual stockings delivered from a reservoir onto about the middle of the stockings carried by the transfer assembly; an insert gripper assembly arranged about the front end of the setting station and for provisionally fixing the position of the fed insert relative to the stockings; a stockings folder assembly arranged along the front end of the setting station and, by its lateral reciprocation, for folding waist and toe end sections of the stockings around the insert in the provisionally fixed state, one over another; an envelope feeder assembly arranged on the table and for feeding individual envelope to a prescribed stand-by position whilst keeping its mouth open; an conveyer assembly arranged on the table and, by its reciprocation, for conveying the stockings folded around the insert to a prescribed position in line with the envelope in the above-described stand-by position; and a stockings encloser assembly arranged on the table facing the downstream terminal of the reciprocal movement of the conveyer assembly and for enclosing the stockings with the insert in the envelope through the open mouth.

The automatic apparatus may additionally include a stockings feeder assembly arranged facing the setting station and for feeding individual stockings sequentially from a given source wherein the stockings are reserved in a pile.

The automatic apparatus further includes an envelope sealing assembly arranged downstreamly of the stockings encloser assembly and for sealing the envelope containing the folded stockings with a gummed tape or tapes.

DESCRIPTION OF THE DRAWINGS

FIGS. 9A through 9M are explanatory drawings for showing the overall operation of the apparatus shown in FIG. 1.

DESCRIPTION OF PREFERRED EMBODIMENTS

General Operation of the Apparatus

Figure 1:
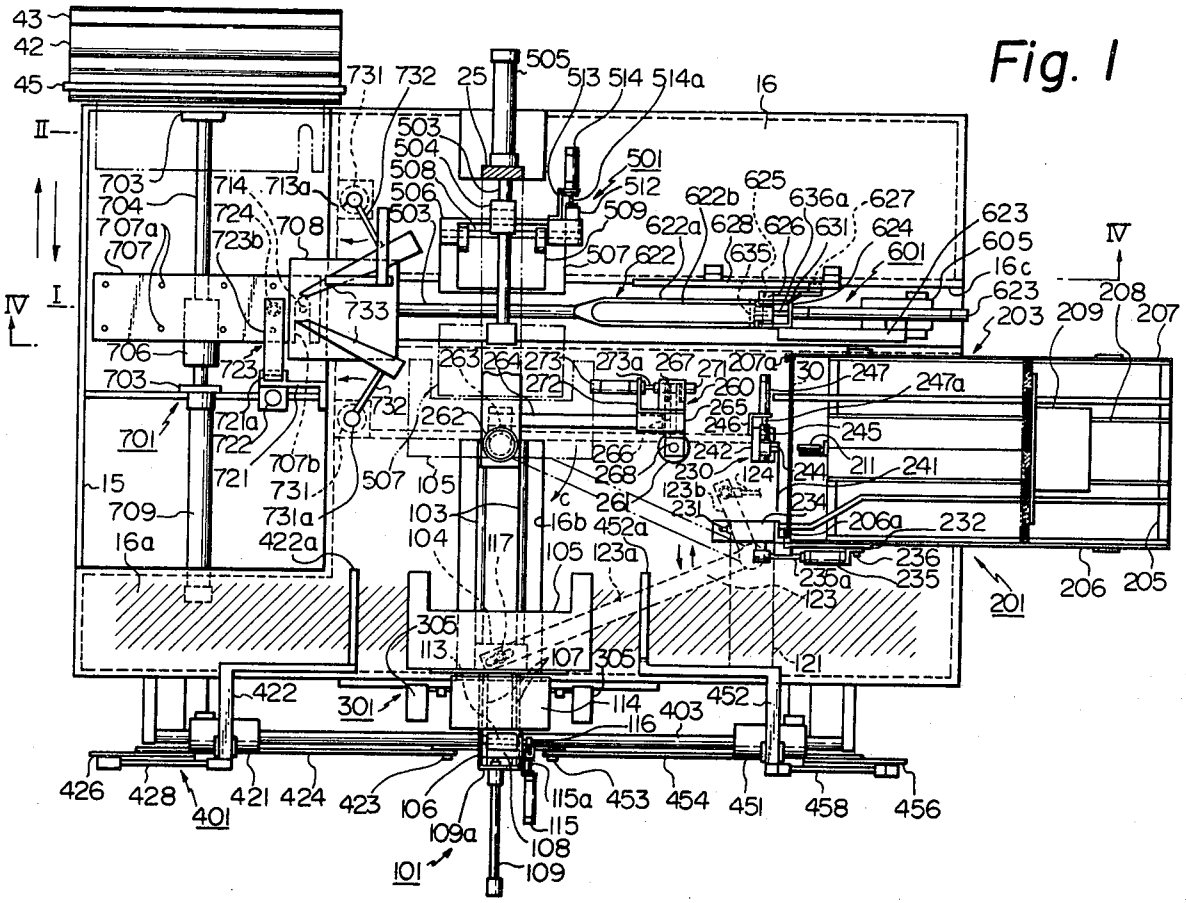
FIG. 1 is a plan view of the first embodiment of the apparatus in accordance with the present invention.

The outline of the stocking packaging process to be carried on the apparatus in accordance with the present invention is as follows, reference being mainly made to FIG. 1.

Main elements of the apparatus are arranged on a stationary table 16 mounted on a pedestal 15. Stockings placed in position on a manual stocking setting station are passed to a conveyer assembly 501 by a transfer assembly 101, which is accompanied with an insert feeder assembly 201 for feeding an individual cardboard insert onto stockings on the transfer assembly 101 periodically. The insert so fed onto the stocking is provisionally gripped by an insert gripper assembly 301. While the gripper assembly 301 is in operation, the waist and leg sections of the stockings under tension are simultaneously folded together around the insert by a stocking folder assembly 401.

The stockings in the folded state are then released from the transfer assembly 101 and passed to a position in line with a later described envelope by a conveyer assembly 501. At the position, the stockings are then packaged into an envelope of thermoplastic material by a stockings encloser assembly 601.

Figure 3:
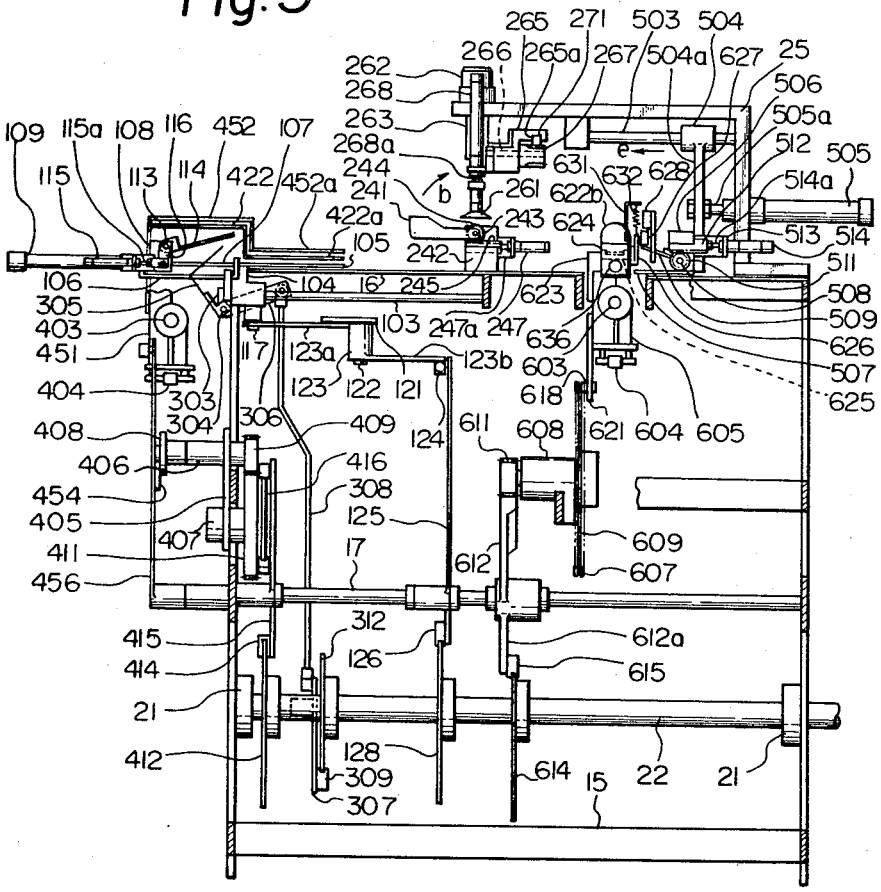
FIG. 3 is a view seen in the direction shown with arrows III in FIG. 2.

As shown in FIG. 3 the table 16 has a large cutout in one end thereof in which an envelope feeder assembly 701 is located. The manual stockings setting station **16*a* is arranged along side of the table 16 as shaded in the illustration. A slot 16*b* is formed in the table 16 in a direction normal to the length of the stockings setting station 16*a* whilst a slot 16 is also formed in the table 16 whilst running normal to the first slot 16*b*. The transfer assembly 101 reciprocates along the first slot 16*b* whilst the encloser assembly 601 is shiftable along the second slot 16*c***.

The Transfer Assembly 101

The construction of the transfer assembly 101 will hereinafter be explained in more detail with reference to FIGS. 1 through 3. As well seen in FIG. 1, a pair of parallel guide shafts 103 are fixed to the pedestal at a level somewhat below the top surface of the table 16 whilst extending in parallel to the first slot **16*b*. A transfer 104 engages with the guide shafts 103 in an arrangement slidable therealong. As noted in FIG. 3, the transfer 104 partly extends over the table 16 in order to fixedly hold a horizontal transfer plate 105 slightly over the top surface of the table 16. On the side opposite to the transfer plate 105, the transferer 104 further carries a L-shaped bracket 106** which extends horizontally.

A pair of parallel guide rods 107 extend along the length of the bracket 106 and a gripper head 108 engages with the guide rods 107 in an arrangement slidable therealong. The free end of the bracket 106 fixedly holds a horizontal air cylinder 109 whose piston rod **109*a* is coupled to the gripper head 108. A rotary shaft 113 is held by the gripper head 108 and carries a grip plate 114 which provisionally grips a folded stocking in order to press it against the transfer plate 105. The above-described gripper head 108 further carries a horizontal air cylinder 115 whose piston rod 115*a* is operationally coupled to one end of the rotary shaft 113 by means of a lever 116**.

As the air cylinder 109 operated to advance the piston rod **109*a*, the gripper head 108 moves along the guide rods 107 and the grip plate 114 is brought to a prescribed position over the transfer plate 105. At this moment the other cylinder 115 operates to withdraw its piston rod 115*a* and the rotary shaft 113 is turned clockwise in FIG. 3 via the lever 116 in order to swing down the grip plate 114 towards the transfer plate 105. When any stockings are present on the transfer plate 105, the stockings are pressed against the transfer plate 105 by the grip plate 114**. That is, the stockings are gripped.

Figure 2:
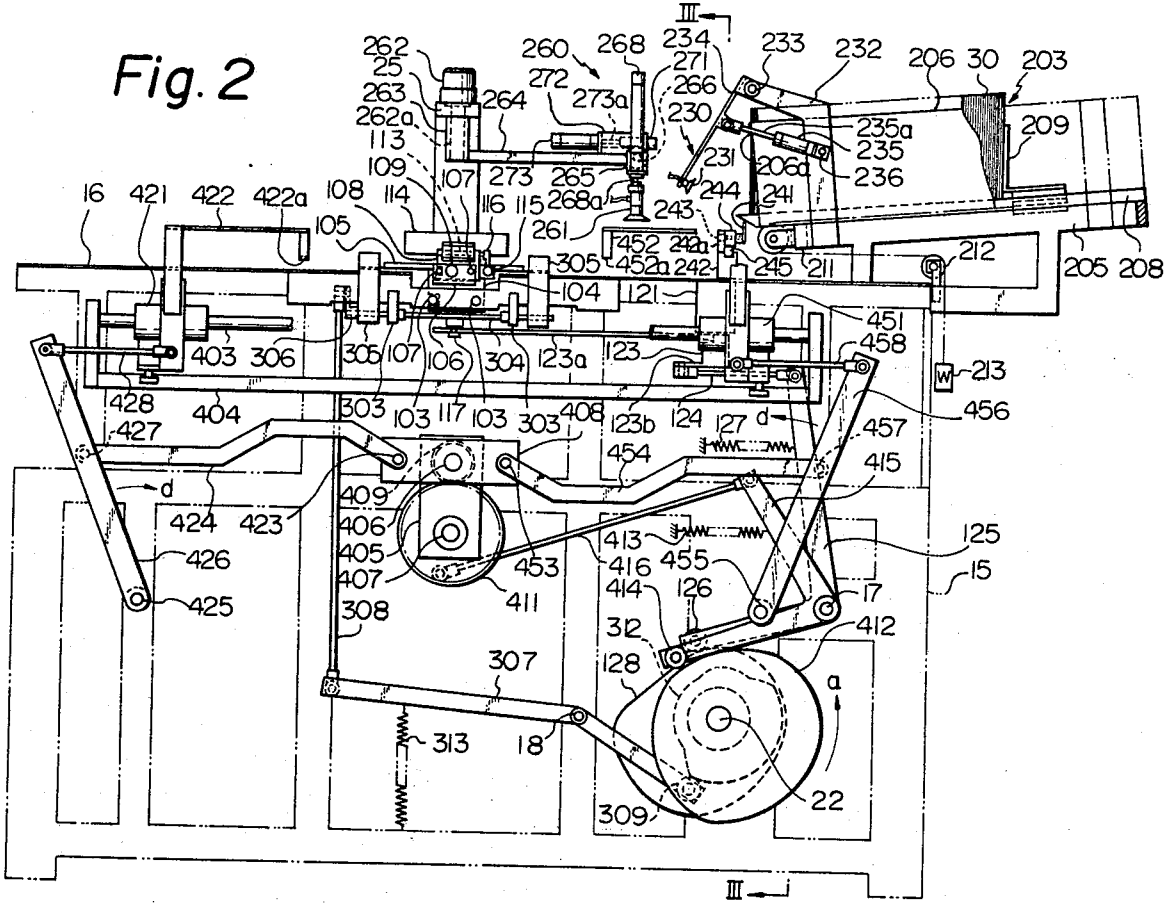
FIG. 2 is a front view of the apparatus shown in FIG. 1.

As shown in FIGS. 1 and 2, a bracket 121 is fixed to the pedestal 15 at a level below the table 16 and a swing lever 123 is pivoted at its apex to the free end of the bracket 121 by means of a pin 122 in an arrangement swingable in a horizontal plane. The swing lever 123 is comprised of long and short branches **123*a* and 123*b* coupled almost normal to each other at the apex of the lever, the end of the long branch 123*a* is idly inserted over a pin 117 fixed to the bottom of the above-described transferer 104, and the end of the short branch 123*b* is coupled to one end of a connecting rod 124 whose another end is coupled to an L-shaped crank lever 125**.

As shown in FIG. 2, a horizontal pin 17 is fixed to the pedestal 15 in order to provide a pivot for the apex of the crank lever 125. The free end of the lower branch of the crank lever 125 rotatably carries a cam follower 126. A cam 128 is fixedly mounted to a drive shaft 128 which is rotatably mounted to the pedestal 15 by means of bearings 21. The above-described cam follower 126 is kept in a pressure contact with the cam 128 by a spring 127 interposed between the upper branch of the crank lever 125 and the pedestal 15.

The drive shaft 22 is driven for intermittent rotation by conventional drive motor and its associated reduction gear etc. (not shown). As the drive shaft 22 is driven for one intermittent rotation in the direction of the arrow "a" in FIG. 2, the cam 128 rotates intermittently in the same direction in order to accordingly swing the crank lever 125 about the pin 17. Upon this swing, the swing lever 123 moves its long branch **123*a* about the pin 122 from the position shown with dot lines to the position shown with chain lines in FIG. 1 and vice versa. Thereupon, the transferer 104 with the transfer assembly 101 reciprocates along the guide shafts 103. That is, the stockings in the gripped state are moved from the manual stockings setting station 106*a* towards the position of the conveyer assembly 501**.

The Insert Feeder Assembly 201

The insert feeder assembly 201 basically has the following function. Stockings are placed under tension in the setting station 106*a* so that the middle of the leg sections is located on the transfer plate 105 of the transfer assembly 101. Thereafter, the foremost one insert 30 is separated from other succeeding inserts 30 stored side by side in an insert reservoir 203 by the operation of a separator mechanism 230. After the separation, the separated insert 30 is brought, by operation of a feeder mechanism 260, to a prescribed position on the transfer plate 105, i.e. onto the middle of the leg sections of the stockings placed under tension on the transfer plate 105.

In FIGS. 1 and 2, the insert reservoir 203 includes an insert support deck 205 arranged on the table, and a pair of spaced side boards 206 and 207 in order to define a space adapted for containing a number of inserts in vertical state in side by side relationship. At the bottom of the space, a guide rail 208 extends in the longitudinal direction of the support deck 205 and a pusher plate 209 engages with a groove (not shown) formed in the guide rail 208 for reciprocation therealong. As better seen in FIG. 2, guide rollers 211 and 212 are disposed to different locations on the support deck 205 and a weight 213 is connected to the pusher plate 209 by means of a suitable wire in engagement with guide rollers 211 and 212 in order to keep the pusher plate 209 in constant contact with the inserts 30 in the reservoir 203 at a prescribed pressure. Before separation, the foremost insert 30 bears on bent sections 206*a* and 207*a* formed at the front ends of the side boards 206 and 207, respectively.

The separator mechanism 230 is provided with a suction mouth piece 231 for separating the foremost insert 30 from the next insert in the reservoir 203. The mechanism 230 is further provided with a separator blade 241 running into the gap between the foremost insert 30 caught by the mouth piece 231 and the next insert within the reservoir 203 for easy supply of the insert 30 by the feeder mechanism 260. A bent vertical bracket 232 is fixed to the one side board 206 of the insert reservoir 203 and a skew swing lever 234 is mounted atop the bracket 232 by means of a pin 233. The suction mouth piece 231 is fixed to the lower end of the swing lever 234 in order to act on the right side lower corner of the insert 30 when seen in the longitudinal direction of the insert reservoir 203. As is clear in FIG. 2, an air cylinder 235 is pivoted at its tail end to one side of the bracket 232 by means of a pin 236 and its piston rod 235*a* is coupled to about the body of the swing lever 234.

As the piston rod 235*a* reciprocates upon operation of the air cylinder 235, the swing lever 234 turns about the pin 233 in order to move the suction mouth piece 231 along a prescriber arcuate locus. Upon this turning, the mouth piece 231 provisionally sucks the right side lower corner of the foremost insert 30 in the reservoir 203 for separation from the next insert.

A pinion gear 244 is rotatably held, by means of a shaft 243, by a holder bracket 242 arranged atop the table 16 in the vicinity of the front end of the reservoir 203. The separator blade 241 is held by and formed in one body with the pinion gear 244 as well seen in FIG. 3. A groove 242*a* is formed in the holder bracket 242 in order to accommodate a slidable pinion rack 245 which is in meshing arrangement with the pinion gear 244. A bracket 246 is fixed to the holder bracket 242 and fixed carries an air cylinder 247 whose piston rod 247*a* is linked to the tail of the pinion rack 245.

As the air cylinder 247 operates to advance the piston rod 247*a*, the pinion gear 244 rotates clockwise in FIG. 3 in order to swing the separator blade 241 in the direction of an arrow "b", and the separator blade 241 slips into the gap between the foremost insert 30 caught by the suction mouth piece 231 and the next insert in the reservoir 203 for separation of the two. After the complete separation, the foremost insert 30 is taken over by a suction mouth piece 261 of the feeder mechanism 260 in order to be placed in the prescribed position on the stockings which are already on the setting station 16*a* of the table 16.

The construction of the feeder mechanism 260 is shown in detail in FIG. 3, in which a reverse L-shaped stand 25 is mounted atop the table 16 at a position near the rear side of the latter. A cylinder 262 is fixed to the free end of the stand 25 with its rotary shaft 262*a* (see FIG. 2) extending vertically downwards. The rotary shaft 262*a* is fixedly covered by a sleeve 263, which in turn carries a radial arm 264. A bracket 265 is fixed to the free end of the arm 264 and holds a rotary shaft 266 extending normal to the arm 264. The one end of the rotary shaft 266 fixedly carries a pinion gear 267 and the outer end an upright air cylinder 268, respectively. The above-described suction mouth piece 261 is disposed to a piston rod 268*a* of the air cylinder 268. A pinion rack 271 is slidably accommodated within a groove 265*a* formed in the bracket 265 and placed in meshing engagement with the above-described pinion gear 267. The bracket 265 carries on its one side an L-shaped bracket 272 which fixedly holds a horizontal air cylinder 273. A piston rod 273*a* of the air cylinder 273 is linked to the tail end of the pinion rack 271.

As the air cylinder 273 operates and its piston rod 273*a* recedes with the pinion rack 271, the pinion gear 267 with the rotary shaft 266 rotates counterclockwise in FIG. 2, and the air cylinder 268 shifts from the upright to horizontal position. As the air cylinder 268 in the horizontal state operates to advance its piston rod 268*a*, the suction mouth piece 261 approaches the foremost insert 30 in order to fully separate it from the next insert in the reservoir 203. The advanced separation by the separator blade 241 successfully prevents the next insert from following the foremost insert 30 at separation of the latter by the suction mouth piece 261.

Next, the air cylinder 273 operates reversely and its piston rod 273*a* with the pinion rack 273 advances so that the air cylinder 268 resumes the upright position. This causes shift of the insert now caught by the mouth piece from a vertical to horizontal position. At this moment, the cylinder 262 operates to ratate its shaft 262*a* clockwise in FIG. 1 over 90 degrees. Thus, the arm 264 with the feeder mechanism 260 is turned in the same direction as shown with an arrow "c" in the drawing. That is, the feeder mechanism 260 is brought from a position in front of the insert reservoir 203 to a prescribed position slightly over the transfer plate 105 of the transfer assembly 101. At this position, the insert 30 is released from the hold by the mouth piece 261 and depositted on the middle of the stockings placed on the transfer plate 105.

Insert Gripper Assembly 301

The construction and operation of the insert gripper assembly 301 will hereinafter be explained in more detail in reference mainly to FIGS. 2 and 3.

The outline of the operation is as follows. After a sheet of insert 30 has been placed in position on the middle of the stockings on the setting station 16*a* by the insert transfer assembly 201, the gripper assembly 301 provisionally presses the insert 30 with the stockings onto the transfer plate 105 of the transfer assembly 101.

In the drawings, a pair of spaced bearings 303 are fixed, in axial alignment, to the front side of the pedestal 15 in order to ratatably carry a horizontal shaft 304 which extends in the width direction of the apparatus. A pair of L-shaped gripper plates 305 are fixed, at spaced positions, to the rotary shaft 304. A swing lever 306 is fixed to one end of the rotary shaft 304 and the free end of the swing lever 306 is coupled atop a connecting rod 308 which extends almost vertically. A bent crank lever 307 is pivoted, at its apex, to the pedestal 15 by means of a pin 18 and its one end is coupled to the lower end of the connecting rod 308 as better seen in FIG. 2. The other end of the crank lever 307 rotatably carries a cam follower 309 which is placed in constant pressure contact with a cam 312 rixedly mounted to the drive shaft 22 by means of a spring 313 interposed between the crank lever 307 and the pedestal 15.

As the drive shaft 22 performs one rotation in the direction shown with the arrow "a" in FIG. 2, the horizontal shaft 304 is driven for simultaneous rotation by the cam 312 on the drive shaft 22 via the elements 309, 307 and 308. The extend of rotation of the horizontal shaft 304 is dependent upon the pattern of the cam 312 on the drive shaft 22, which is shown in more detail in FIG. 7.

Figure 7:
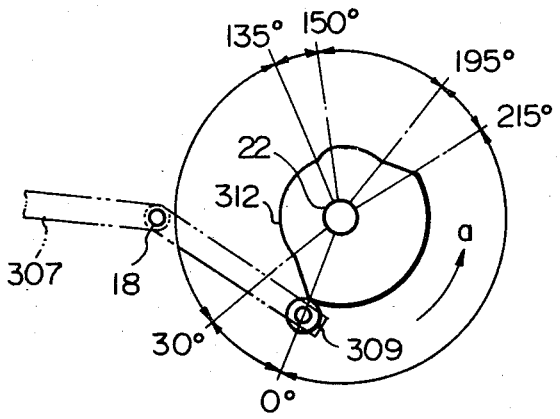
FIG. 7 is an explanatory front view of the operating cam used for the insert gripper assembly of the apparatus shown in FIG. 1.
Figure 8:
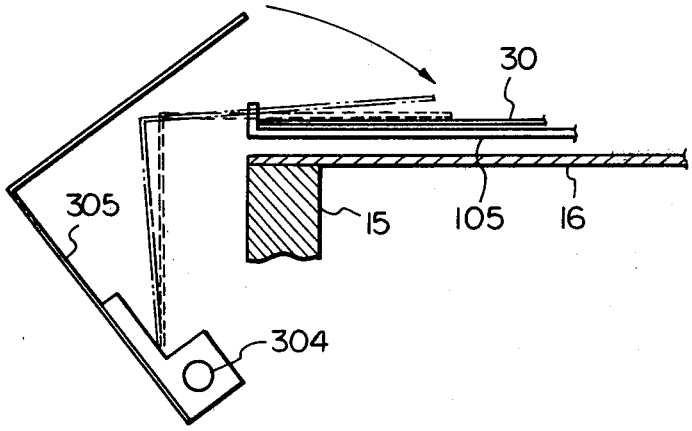
FIG. 8 is an enlarged side view for showing the operation of the insert gripper assembly.

In FIG. 7, as the cam follower 309 travels from the 0 to 30 degrees position on the cam 312, the horizontal shaft 304 rotates clockwise in FIG. 8 over prescribed angles in order to shift the gripper plates 305 from the position shown with solid lines to the position shown with dot lines, thereby pressing the insert with the stockings onto the transfer plate 105.

As the cam follower 309 travels from the 30 to 135 degrees position on the cam 312, the horizontal shaft 304 dwells to keep the gripper plates 305 at the place shown with the dot lines. During this dwell, consequently, the stockings are folded by the stockings folder assembly 401 as hereinafter described in more detail.

As the cam follow 309 travels from the 135 to 150 degrees position, the horizontal shaft 304 is driven for slight counterclockwise rotation and the gripper plates 305 are moved from the position shown with the dot lines to the position shown with chain lines in order to slightly relieve the grip on the insert. This condition continues from the 150 to 195 degrees position on the cam 312. Meanswhile, the stockings folded around the insert are moved towards the conveyer assembly 501 by movement of the transferer assembly 101 along the guide shafts.

By a further travel of the cam follower 309 from the 195 to 215 degrees position on the cam 312, the horizontal shaft 304 completes its full counterclockwise rotation and the gripper plates 305 resume the initial position shown with the solid lines in FIG. 8. As the cam follower 309 travels from the 215 to 360 degrees position on the cam 312, the gripper plates 305 dwell at the initial position whilst waiting for the next cycle operation.

Stockings Folder Assembly 401

The main function of this assembly is to fold the waist and leg sections of stockings simultaneously around an insert placed about the middle of the stockings, reference being made mainly to FIGS. 1, 2 and 3.

A pair of parallel, horizontal guides 403 and 404 are fixed to the front side of the pedestal 15 whilst being vertically spaced from each other as better seen in FIG. 2. The upper guide 403 is in the form of a shaft and the lower guide 404 a bar. A pair of slide heads 421 and 451 engage the guides 403 and 404 in an arrangement slidable therealong, each having a folder bar 422 (or 452) at its upper end. The folder bar 422 (or 452) is provided with a folder rod 422*a* (or 452*a*) which is located slightly above the top face of the setting station 16*a* and extends substantially normal to the width direction of the apparatus. As the slide heads 421 and 451 move towards each other along the guides 403 and 404, the folder rods 422*a* and 452*a* come across at about the middle of the transfer plate 105.

More specifically, a plate bearing 405 is fixed to the middle of the front side of the pedestal 15 as shown in FIG. 2, and rotatably carries a pair of parallel shafts 406 and 407 which are spaced vertically from each other. One end of the upper shaft 406 is fixed to the middle of a rectangular turnable plate 408 located somewhat outside the front face of the pedestal 15. The other end of the upper shaft 406 fixedly carries a small driven gear 409. On the same side, the lower shaft 407 fixedly carries a large drive gear 411 placed in meshing engagement with the driven gear 409 on the upper shaft 406. At both lateral ends, the turnable plate 408 carries, by means of 423 and 453 fixed thereto, a pair of like connecting bars 424 and 454 which substantially coextend with the trunable plate 408. Swing bars 426 and 456 are pivoted, at their lower ends, to the front side of the pedestal 15 by means of pins 425 and 455, respectively. The left side connecting bar 424 is linked, at its outer end, to the middle of the left side swing bar 426 by means of a pin 427 and, likewise, the right side connecting bar 455 to the right side swing bar 456 by means of a pin 457. The top end of the left side swing bar 426 is linked to the left side slide head 421 by means of a connecting rod 428, and the right side swing bar 456 to the right side slide head 451 by means of a connecting rod 458, respectively.

An L-shaped crank lever 415 is pivoted at its apex to the pin 17, and its lower branch rotatably carries a cam follower 414 which is placed in pressure contact with a cam 412 on the drive shaft 22 by a spring 413 interposed between the upper branch of the crank lever 415 and the pedestal 15. The upper end of the upper branch of the crank lever 415 is linked to a peripheral section of the above-described drive wheel 411 by means of a connecting rod 416.

As the cam 412 on the drive shaft 22 rotates, the drive gear 411 is driven for simultaneous rotation via the elements 414, 415 and 416. The extent of the rotation of the drive gear 411 is dependent upon the pattern of the cam 412 on the drive shaft 22. When the drive gear 411 rotates counterclockwise in FIG. 2, the driven gear 409 naturally rotates clockwise accompanying same directional turning of the turnable plate 408. Then, the connecting bars 424 nd 454 are pulled inwards in order to swing the bars 426 and 456 in directions shown with arrows "d" in FIG. 2. The slide heads 421 and 451 are then urged to move towards each other along the guides 403 and 404 by such movement of the bars 426 and 456 so that the folder rods 422*a* and 452*a* fold the waist and leg sections of the stockings on the setting station 16*a* around the insert.

After the folding is complete, the drive gear 411 is driven for reverse rotation and the slide heads 421 and 451 move away from each other along the guides 403 and 404 in order to disengage their folder rods 422*a* and 452*a* from the stockings folded around the insert.

Conveyer Assembly 501

The outline of the operation of the conveyer assembly 501 is as follows, which is arranged shiftable in a direction normal to the slot 16*c* in the table 16 (see FIG. 1).

After the stockings are folded around the insert by the folder assembly 401, the conveyer assembly 501 takes over the folded stockings from the transfer assembly 101 and shifts them to a prescribed position in line with a corresponding envelope standing by, that is a position on the center line of the above-described slot 16*c*.

Figure 4:
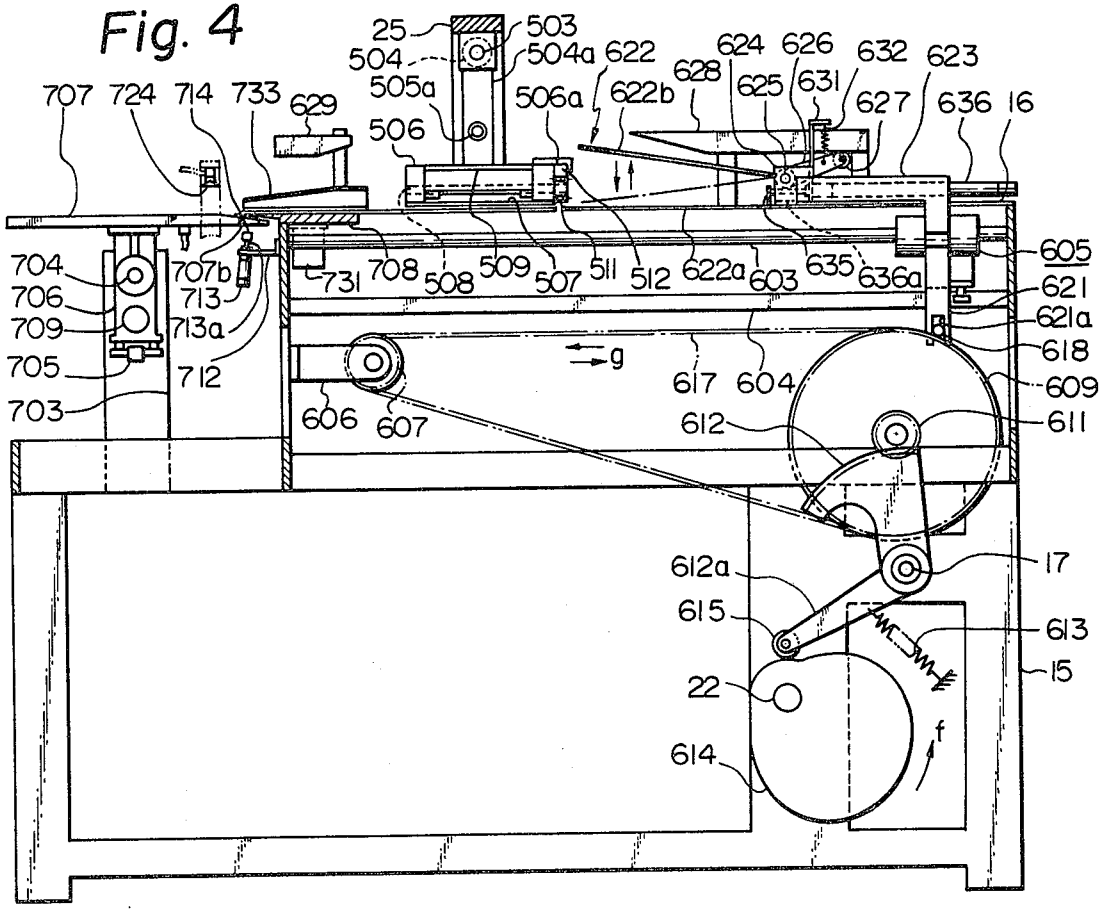
FIG. 4 is a view seen in the direction shown with arrows IV in FIG. 1.

In FIGS. 1, 3 and 4, a guide shaft 503 is arranged below and in parallel to the horizontal section of the above-described stand 25 and a sleeve 504 is inserted slidably over the guide shaft 503. The sleeve 504 is accompanied with a radial arm 504*a* extending downwards. At a level corresponding to the middle of the arm 504*a*, an air cylinder 505 is horizontally secured to the vertical section of the stand 25 with its piston rod 505*a* being fixed to about the middle of the arm 504*a*. The lower end of the arm 504*a* is fixed to a channel-shaped horizontal bracket 506 accompanied with a horizontal carrier plate 507 for the stockings. The bracket 506 further carries a rotary shaft 508 extending in the width direction of the apparatus and a gripper plate 509 is fixed at its one side to the rotary shaft 508 in order to provide provisional grip on the stockings received from the transfer assembly 101. One end of the rotary shaft 508 fixedly carries a pinion gear 511 which meshes with a pinion rack 512 slidably accommodated within a groove 506*a* formed in the bracket 506 (see FIG. 4). As better seen in FIG. 3, an air cylinder 514 is fixed to a Z-shaped bracket 513 mounted to the channel-shaped bracket 506 and its piston rod 514*a* is linked to the tail of the pinion rack 512.

As the air cylinder 505 operates to advance its piston rod 505*a*, the sleeve 504 with the entire conveyer assembly 501 moves along the guide shaft 503 in the direction shown with an arrow "e" in FIG. 3. That is, the conveyer assembly 501 is moved towards the transfer assembly 101 across the slot 16*c* in the table. Next, the air cylinder 514 operates to advance its piston rod 514*a* with the associated pinion rack 512. This movement of the pinion rack 512 causes corresponding rotation of the pinion gear 511 with the rotary shaft 508 in the counterclockwise direction in FIG. 3 in order to swing the gripper plate 509 in the same direction, thereby the stockings on the transver assembly 101 being provisionally pressed onto the carrier plate 507. Under this condition, the air cylinder 505 now operates reversely to withdraw its piston rod 505*a* so that the entire conveyer assembly 501 resumes its original position. Thus, the stockings under the grip by the gripper plate 509 is kept at the position in line with the envelope standing by, i.e. the position on the longitudinal center line of the slot 16*c* in the table 16.

Stockings Encloser Assembly 601

The construction and operation of the stockings encloser assembly 601 will now be described in more detail in reference to FIGS. 1, 3 and 4. A pair of horizontal guides 603 and 604, which are vertically spaced from each other, are arranged under the table whilst extending normal to the slot 16*c* in the table 16. An encloser head 605 is mounted to the guides 603 and 604 in an arrangement slidable therealong. As better seen in FIG. 4, a bearing 606 is fixed to the left, inner side of the pedestal 15 in order to rotatably carry a small sprocket wheel 607. In accordance with this, another bearing 608 is fixed to the right, inner side of the pedestal 15 in order to ratatably carry a large sprocket wheel 609 formed in one body with a gear 611 (see FIG. 3). Reverting to FIG. 4, a sector gear 612 is pivoted at its apex to the pin 17 in meshing engagement with the gear 611. The sector gear 612 is provided on its apex with a radial arm 612*a* whose free end rotatably carries a cam follower 615. A cam 614 is fixedly mounted to the drive shaft 22 and the cam follower 615 is kept in pressure contact with the cam 614 by means of a spring 613 interposed between the arm 612*a* and the pedestal 15. The two sprocket wheels 607 and 609 are operationally coupled by an endless chain 617 which is provided, on one of its links, with a horizontal guide pin 618. A plate 612 is fixed sideways the encloser head 605 and its lower recess 621*a* accommodates the guide pin 618 on the endless chain 617.

As the cam 614 on the drive shaft 22 performs one rotation in the direction shown with the arrow "a" in FIG. 4, the sector cam 612 is driven for reciprocal swing movement via the elements 615 and 612*a*. Thereupon the gear 611 with the sprocket wheel 609 rotates into clockwise and counterclockwise directions. This accompanies like reciprocating movement of the chain 617 as shown with arrows "f" in FIG. 4 so that the encloser head 605 is driven for corresponding reciprocation along the guides 603 and 604.

The encloser head 605 is further provided with an encloser 622 and a pusher plate 635. The encloser 622 provisionally grips the stockings taken over from the conveyer assembly 501 in order to enclose the same in an envelope. The pusher plate 635 pushes the stockings forwards with the envelope. The pusher plate 635 pushes the stockings forwards with the envelope.

As better seen in FIG. 4, a horizontal bracket 623 is fixed to one side of the encloser head 605 and carries, at its front end, a channel-shaped bracket 624. A stationary plate 622*a* of the encloser 622 is fixed to the bottom face of the bracket 624. A swing plate 622*b* of the encloser 622 is fixed to a rotary shaft 625 held by the bracket 624. One end of the rotary shaft 625 fixedly carries a lever 626 which rotatably carries, at its free end, a cam follower 627. A pair of plate cams 628 and 629 are arranged on the table 16 whilst being spaced in the travelling direction of the encloser head 605. A reverse L-shaped spring hook 631 is mounted to the bracket 624 and a spring 632 is interposed between the spring hook 631 and the lever 626 in order to urge the rotary shaft 625 to rotate counterclockwise in FIG. 4 so that the swing plate 622*b* should be always kept in pressure contact with the stationary plate 622*a* as shown with chain lines in FIG. 4. In fact, however, engagement of the cam follower 627 with the plate cams 628 and 629 keeps the swing plate 622*b* separate from the stationary plate 622*a* against tension by the spring 632 as shown with solid lines in FIG. 4. An air cylinder 636 is horizontally fixed to the back end of the channel-shaped bracket 624 and its piston rod 636*a* is linked to the pusher plate 635 so that the pusher plate 635 is slidable on the stationary plate 622*a* of the encloser 622.

In operation, when the encloser head 605 travels leftwards in FIG. 4, the cam follower 627 is relieved from engagement with the plate cam 628 and the swing plate 622*b* of the encloser 622 is brought into pressure contact with the stationary plate 622*a* in order to have a grip on the stockings set to the position in line with an envelope by the conveyer assembly 501. Whilst keeping this grip, the encloser head 605 further travels leftwards along the guides 603 and 604 in order to enclose the stockings gripped by the encloser 622 into the envelope standing by. After the enclosing, the cam follower 627 comes into engagement with the other plate cam 629 so that the swing plate 622*b* separates from the stationary plate 622*a* within the envelope in order to relieve the grip on the stockings. Thereafter the air cylinder 636 operates to advance the pusher plate 635 via the piston rod 636*a* along the stationary plate 622*a* in order to push the stockings with the envelope forwards. Thus, the stockings with the envelope is discharged off the encloser 622. Then, the encloser 622 is driven for movement towards its initial position by operation of the encloser head 605.

Envelope Feeder Assembly 701

The construction and operation of the envelope feeder assembly 701 will hereinafter be explained in more detail in reference to FIGS. 1, 4, 5 and 6A.

Figure 5:
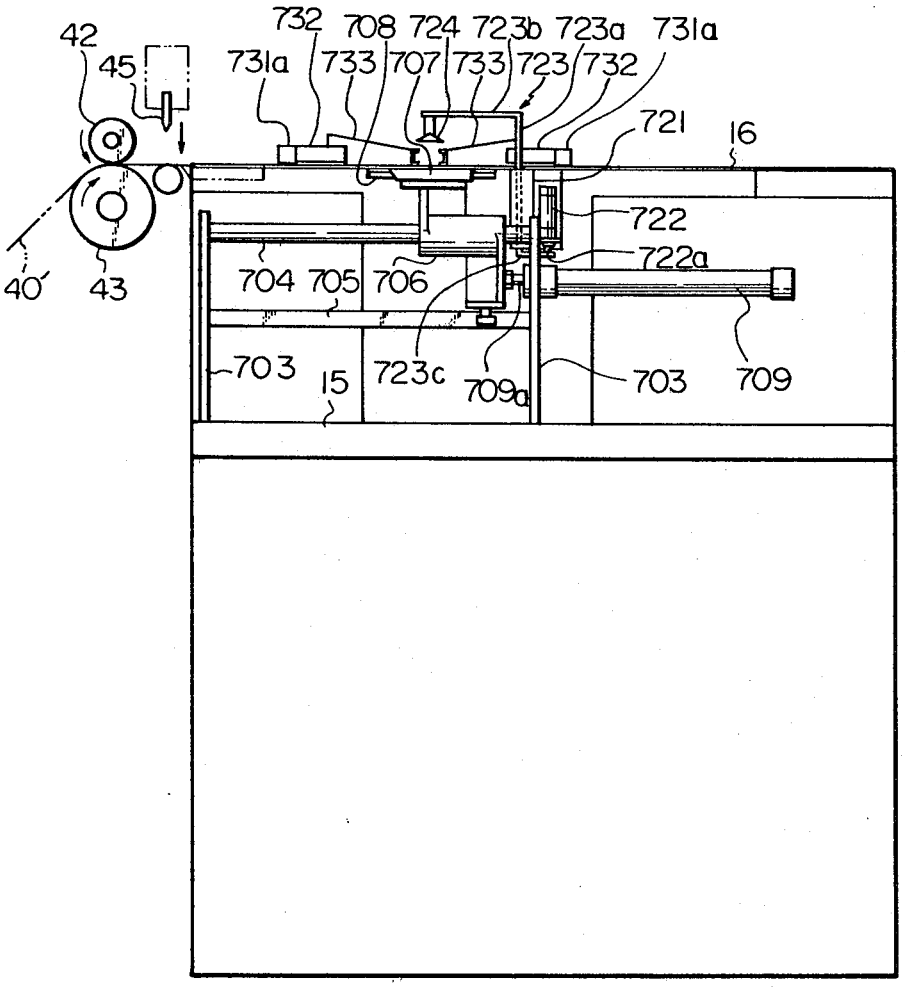
FIG. 5 is a left side view, partly omitted, of the apparatus shown in FIG. 1.
Figure 6A:
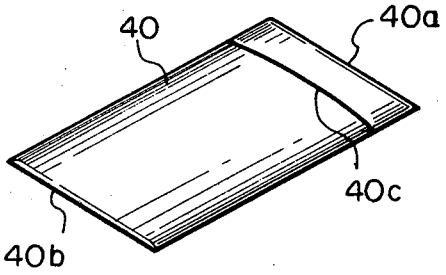
FIG. 6A is a perspective view of an envelope usable for packing the stockings in accordance with the method of the present invention.

An envlope 40 shown in FIG. 6A is prepared by delivering a film strip 40' of transparent, thermoplastic material from a supply roll (not shown) into a nip between a pair of cooperating feed rollers 42 and 43, and severing transversely by a head cutter 45 arranged downstreamly of the feed rollers 42 and 43. The feed rollers 42 and 43 perform periodical, intermittent rotations in the direction of arrows shown in FIG. 5 in order to deliver the film strip 40' of a length corresponding to the length of each envelope 40. During the dwell of the rollers 42 and 43, the heat cutters 45 lowers in order to effect simultaneous fusing and cutting of the envlope 40 which is open at one longitudinal end as shown in FIG. 6A. The film strip 40' is folded in two superposed layers prior to supply to the feed rollers 42 and 43, the one layer being wider than the other layer so that a flap 40*a* should be formed on the resultant envelope 40. Next, the envelope 40 thus prepared is brought from a position II close to the heat cutter 45 (shown with chain lines in FIG. 1) to a stand-by position, i.e. a position I (shown with solid lines in FIG. 1) on the extension of the center line of the slot 16*c* in the table 16.

In FIG. 1, a pair of stands 703 are mounted to the table 16 on the left side of the slot 16*b* whilst being spaced from each other in the longitudinal direction of the slot 16*b* and a pair of vertically spaced guides 704 and 705 are supported horizontally by the stand 703 so that a carrier head 706 having a suction element 707 is reciprocal along the guides 704 and 705 (see FIG. 5). The suction element 707 takes the form of a cavitious box having a number of suction holes 707*a* formed in its top surface and a U-shaped groove 707*b* formed in its front inclined surface. The groove 707*b* should face the inclined bottom surface of a plate 708 extending from the pedestal 15 when the carrier head 706 is located at the above-described position I. An air cylinder 709 is horizontally fixed to one of the stands 703 and its piston rod 709*a* is linked to the back of the carrier head 706.

Figure 6B:
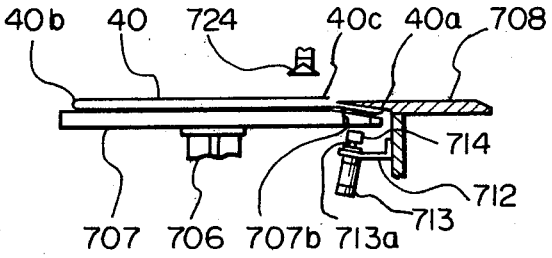
FIGS. 6B through 6F are explanatory drawings for showing the operation of the insert feeder assembly of the apparatus shown in FIG. 1.

As the air cylinder 709 operates to advance its piston rod 709*a*, the carrier head 706 with the suction element 707 shifts from the position I to the position II. The envelope 40 separated from the film strip 40' by the head cutter 45 is then caught by suction onto the top surface of the suction element 707 at the position II. As the air cylinder 709 further operates to withdraw its piston rod 709*a*, the carrier head 706 returns to its initial position so that the envelope 40 caught by the suction element 707 is brought from the position II to the position I. The condition of the envelope 40 at the position I is shown in FIG. 6B. As is clear from the illustration, the flap 40*a* of the envelope 40 under this condition is located within a gap between the front inclined surface of the suction element 707 and the bottom inclined surface of the plate 708.

A mechanism is arranged at the stand-by position of the envelope 40, i.e. the position I, in order to open the mouth 40*c* of the envelope and keep such an open condition. In FIG. 4, an L-shaped bracket 712 is fixed to a left side framework of the pedestal 15 under the table 16, and an air cylinder 713 is held vertically by the bracket 712 whilst facing the bottom inclined surface of the plate 708. A piston rod 713*a* of the air cylinder 713 is provided at its free end with a pressor piece 714 made of a friction resistant, high abrassive material.

Reverting to FIG. 5, an upright bracket 721 is fixed to a left side framework of the pedestal 15 under the table 16 and an air cylinder 722 is held by the bracket 721 with its piston rod 722*a* being directed downwards. A rectangular hole 721*a* is formed vertically through the bracket 721 (see FIG. 1) and a vertical branch 723*a* of a bent lever 723 is slidably inserted into the hole 721*a*. A suction mouth piece 724 is arranged on an upper horizontal branch 723*b* of the bend lever 723 and a lower horizontal branch 723*c* is linked to the piston rod 722*a* of the air cylinder 722.

On the back side of the framework carrying the brackets 712 and 721, a pair of vertical, rotary cylinders 731 are arranged whilst being adequately spaced from each other in the longitudinal direction of the slot 16*b*. Rotary shafts 731*a* of the cylinders 731 project over the top surface of the table 16 as better seen in FIG. 1. A lever 732 extends radially from each shaft 731*a* and an opener pawl 733 is fixed to the end of the lever 732. The pair of opener pawls 733 normally assume the position shown in FIG. 1.

Figure 6C:
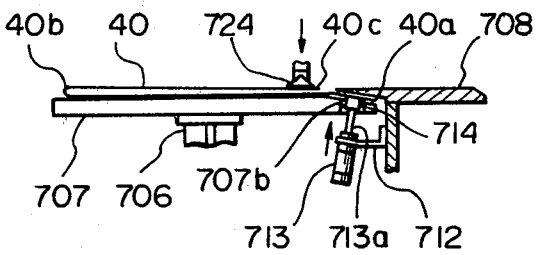
Figure 6D:
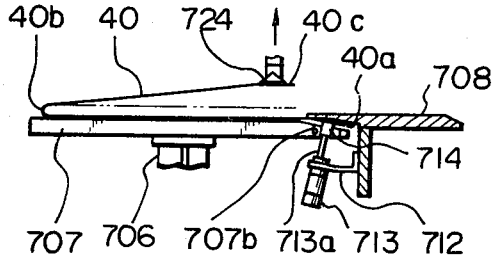

After the envelope 40 has been brought to the position I, the air cylinder 713 operates to lift the pressor piece 714 through the groove 707*b* in the suction element 707 in order to press the flap 40*a* of the envelope 40 against the bottom inclined surface of the plate 708 (see FIG. 6C). Under this condition, the air cylinder 721 on the bracket 721 operates to cause vertical reciprocation of the bent lever 723 via its piston rod 722*a*, and the suction mouth piece 724 on the upper horizontal branch 723*b* of the lever 723 sucks the mouth 40*c* of the envelope 40 in order to open it as shown in FIG. 6D.

Figure 6E:
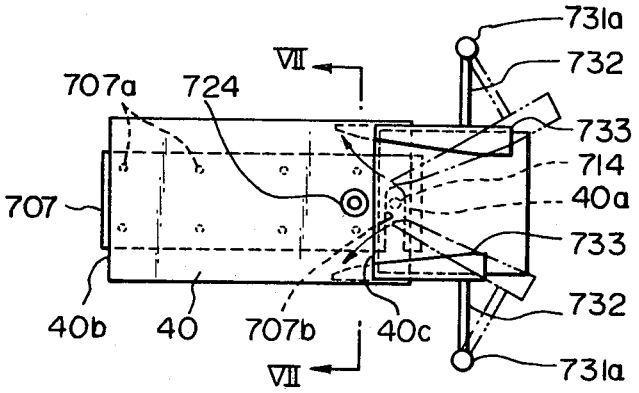
Figure 6F:
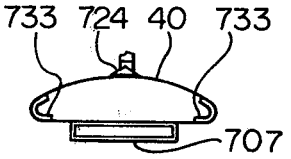

Subsequently, the two rotary cylinders 731 start to operate simultaneously and their rotary shafts 731 rotate in opposite directions shown with arrows in FIG. 1 in order to put the swing levers 732 in a substantially parallel state shown in FIG. 6E. Thus, the opener pawls 733 are placed inside the envelope 40 and keep its mouth 40*c* in the open state as shown in FIGS. 6E and 6F. Enclosing of the stockings by the above-described encloser assembly 601 starts under this condition.

Overall Operation of the Apparatus

Overall operation of the apparatus will hereinafter explained stepwise in reference to FIGS. 9A through 9M.

Figure 9A:
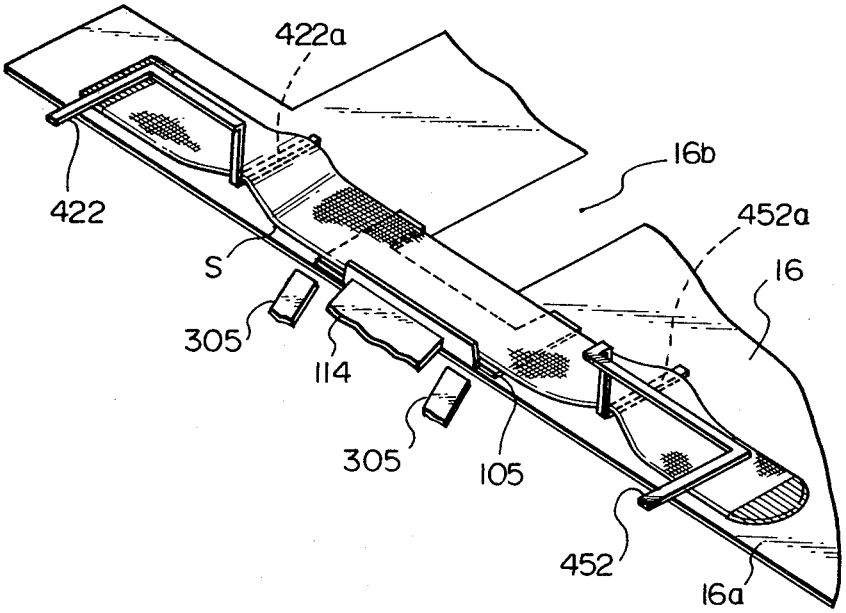

An operator standing in front of the apparatus places manually stocking S under tension on the setting station 16*a* of the table 16 so that the middle of the leg sections is located on the transfer plate 105 of the transferer assembly 101 as shown in FIG. 9A. Thereafter the operator switches on the apparatus for a further full automatic operation.

Figure 9B:
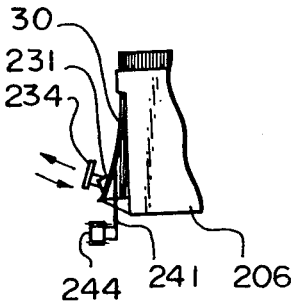
Figure 9C:
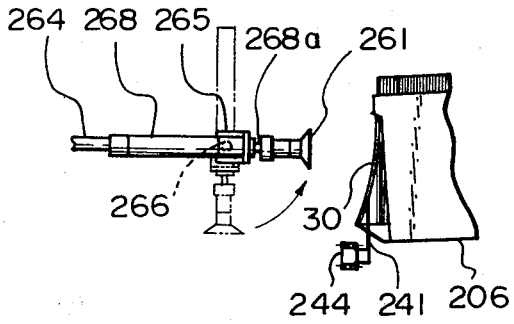

The automatic operation starts with feeding of a cardboard insert 30 onto the stockings S on the setting station 16*a*. The foremost insert 30 is separated from the next insert in the insert reservoir 203 whilst being caught by the suction mouth piece 231 of the separator mechanism 230, and the separator blade 241 slips into the gap between the foremost and next inserts 30 as shown in FIG. 9B.

Figure 9D:
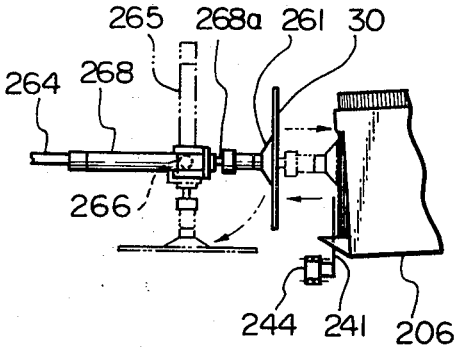

Next, the mouth piece 261 is brought from the vertical to horizontal position as shown in FIG. C, and moves towards and away from the foremost insert 30 in the reservoir 203 in order to separate it from the next insert as shown with dot lines in FIG. 9D.

Figure 9E:
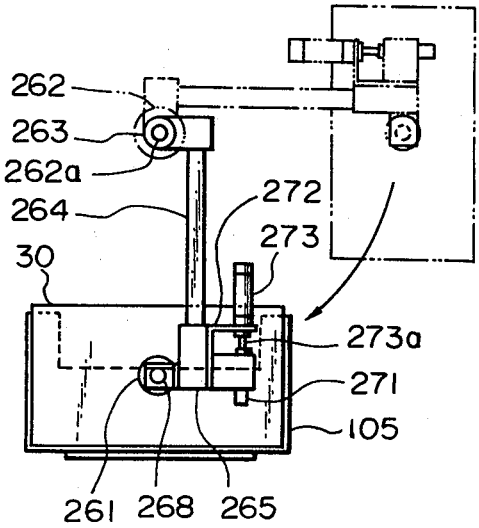

Thereafter, the mouth piece 261 resumes its initial vertical position and the arm 264 is turned over 90 degrees in order to bring the insert 30 onto the middle of the leg sections of the stockings S on the transfer plate 105. This condition is shown in FIG. 9E. Next, the pair of gripper plates 305 swing downwards in order to provisionall press the insert 30 with the stockings S onto the transfer plate 105 as shown in FIG. 9F.

Figure 9H:
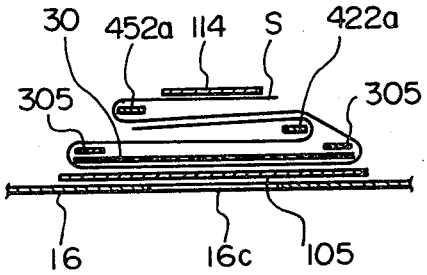

Concurrently with this gripping operation of the gripper plates 305, the folder assembly 401 operates to shift the folder bars 422 and 452 towards the middle of the stockings S so that the waist and leg sections of the stockings S are folded over around the insert 30 at about the middle. Next, the grip plate 114 of the transferer assembly 101 advances to a prescribed position over the transfer plate 105 and, at that position, swings downwards in order to firmly press the folded stockings S with the insert onto the transfer plate 105 as shown in FIGS. 9G and 9H. It should be noted, however, that the gap between the grip and transfer plates 114 and 105 is illustrated larger in FIG. 9H than the true size for better understanding of readers.

Next, the folded stockings S with the insert 30 have to be passed over the transferer to conveyer assembly 501 in order to be brought to the position in line with the envlope 40 already standing, i.e. the position on the center line of the slot 16*c* in the table 16.

Figure 9I:
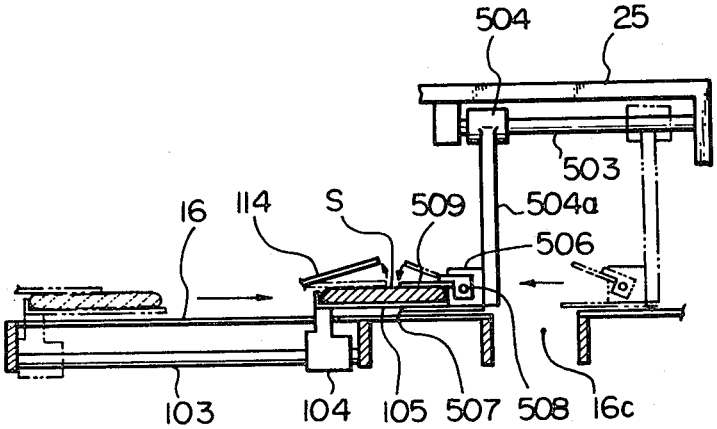
Figure 9J:
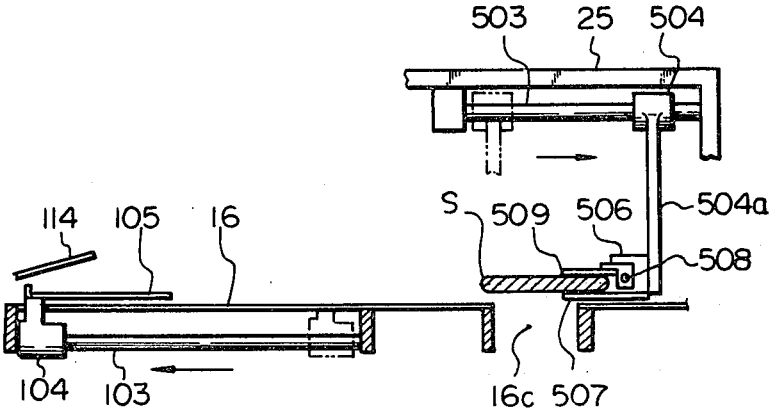

For this effect, the transferer assembly 101 travels along the guide shaft 103 whilst holding the folded stockings S, and next the conveyer assembly 501 moves in the direction across the slot 16*c* along the guide shaft 503. These movements lasts until both assemblies 101 and 501 face each other at about the center of the table 16. This condition is shown in FIG. 9I.

Under this condition, the gripper plate 509 of the conveyer assembly 501 swings down in order to press the right half of the stockings caught by the grip plate 114 onto the carrier plate 507, and the grip by the grip plate 114 is relieved in order to hand over the stockings S to the conveyer assembly 501. This process is illustrated in FIG. 9I. Thereafter, the transferer and conveyer assemblies 101 and 501 both return to their initial positions so that the stockings are placed in the position in line with the envelope 40 standing by.

Figure 9K:
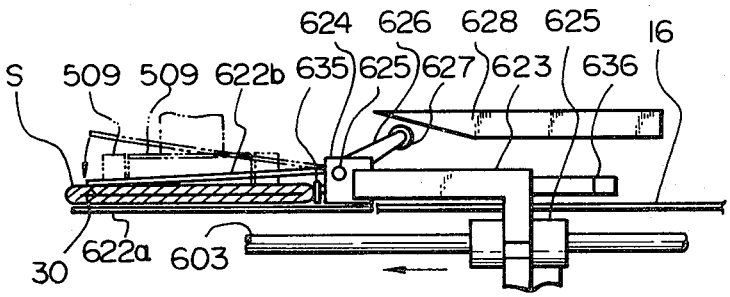

Next, the stockings S have to be enclosed in the envelope 40 standing by with its mouth 40*c* being open. To this end, the encloser head 605 of the encloser assembly 601 advances along the guides 603 and 604. By this movement of the encloser head 605, the cam follower 627 is first releaved from engagement with the right side plate cam 628 (see FIG. 4) so that the swing plate 622*b* of the encloser 622 is brought into pressure contact with the stationary plate 622*a* in order to apply temporary grip to the stockings S as shown in FIG. 9K.

Just before this application of grip by the encloser 622, the stockings S are released from the grip by the gripper plate 509 of the conveyer assembly 501. Consequently, the stockings S under grip by the encloser 522 further advances into the envelope 40 at the stand-by position.

Since the mouth 40*c* of the envelope 40 is kept open as shown in FIGS. 6E and 6F by operation of the pair of opener pawls 733 of the envelope feeder assembly 701, the stockings S can be quite smoothly and quickly enclosed into the envelope by operation of the encloser 622 of the encloser assembly 601. The opener pawls 733 provide a sort of guide for smooth introduction of the stockings S into the envelope 40.

Figure 9L:
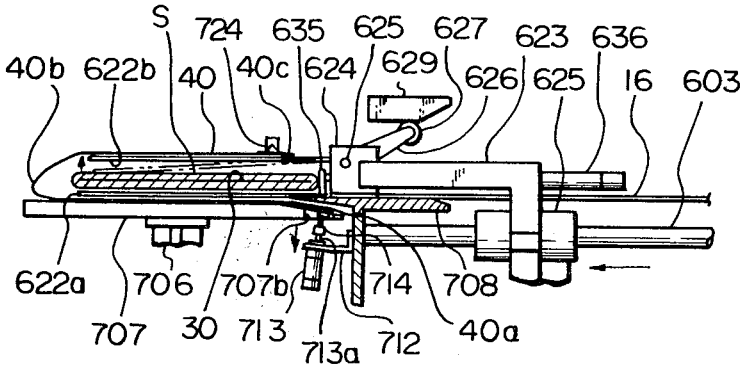
Figure 9M:
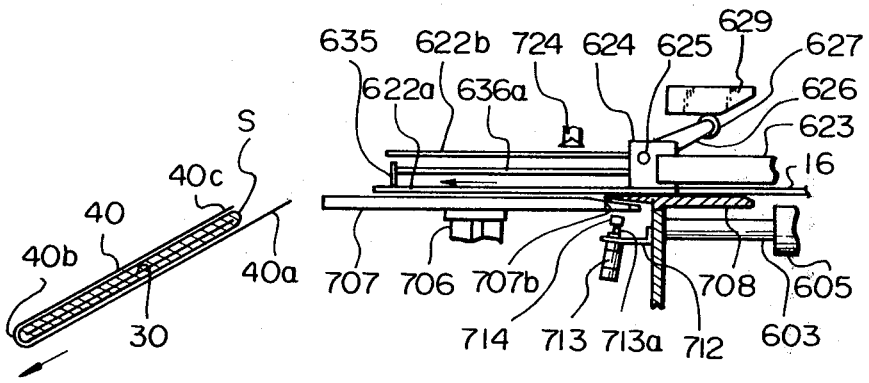

After the stockings S have been fully enclosed in the envelope 40, the cam follower 627 now comes into engagement with the left side plate cam 629 (see FIG. 4) in order to release the stockings S in the envelope 40 from the grip by the enclosure 622 as shown in FIG. 9L. Concurrently with this process, suction on the envelope 40 by the suction element 707 and grip on the flap 40*a* of the envelope 40 by the pressor piece 714 are both cancelled. Thereafter, the pusher plate 635 of the encloser assembly 601 advances along the stationary plate 622*a* in order to discharge the envelope 40 containing the stockings S outside the apparatus for subsequent proper transportation.

By repeating the above described steps, stockings manually placed on the setting station 16*a* are sequentially and fully automatically packaged in envelopes. Incidently, the above-described folding of the stockings, including feeding of the insert, is carried out concurrently with enclosing of the precedingly folded stockings into the envelope.

Figure 10:
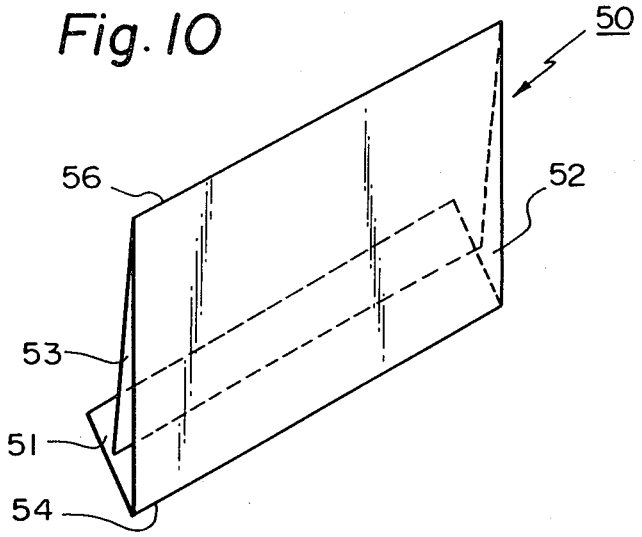
FIG. 10 is a perspective view of a foldable insert made up of three sections.

In the case of the foregoing embodiment, a flat cardboard insert was used for folding stockings therearound. There is a case where another type of cardboard or like insert is used. One example of such an insert is shown in FIG. 10, in which the insert 50 include three sections folded along bending edges, i.e. a back cover section 51, a front cover section 52, and an insert section 53. Letters and/or designs are usually printed on the outside surface of the front cover section 52 for advertising or other descriptive purposes. The back and front cover sections 51 and 52 are folded each other along the first bending edge 54 whilst the the front cover and insert sections 52 and 53 are folded each other along the second bending edge 56.

In operation, the insert section 53 is placed on the middle of the leg sections of stockings, the waist and leg sections are folded around the insert section 53, and the front and back sections 52 and 51 are folded around the stockings in advance to enclosing into an envelope.

In accordance with the second embodiment of the present invention, an individual folded insert is delivered from a reservoir, opened flat and placed in position on stockings on the setting station.

Figure 11:
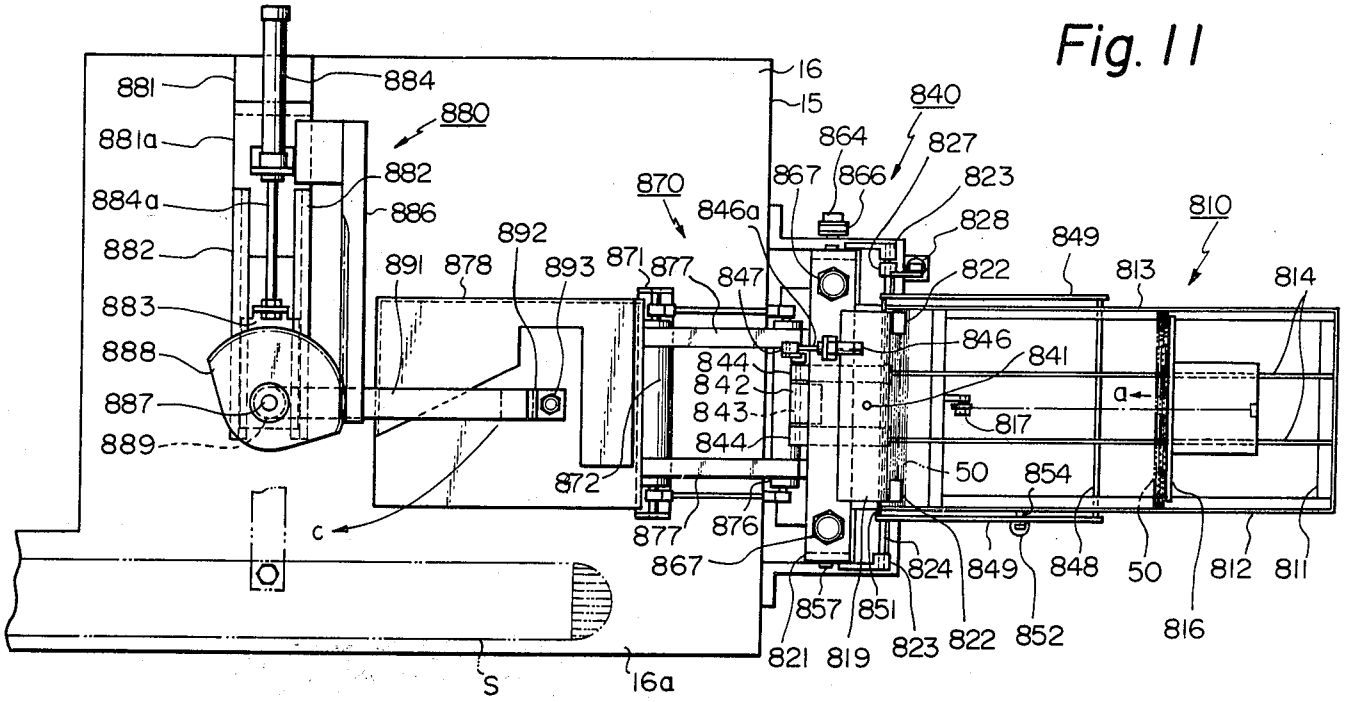
FIG. 11 is a plan view of the second embodiment of the apparatus of the present invention provided with an insert feed assembly used in combination with the insert shown in FIG. 10.
Figure 12:
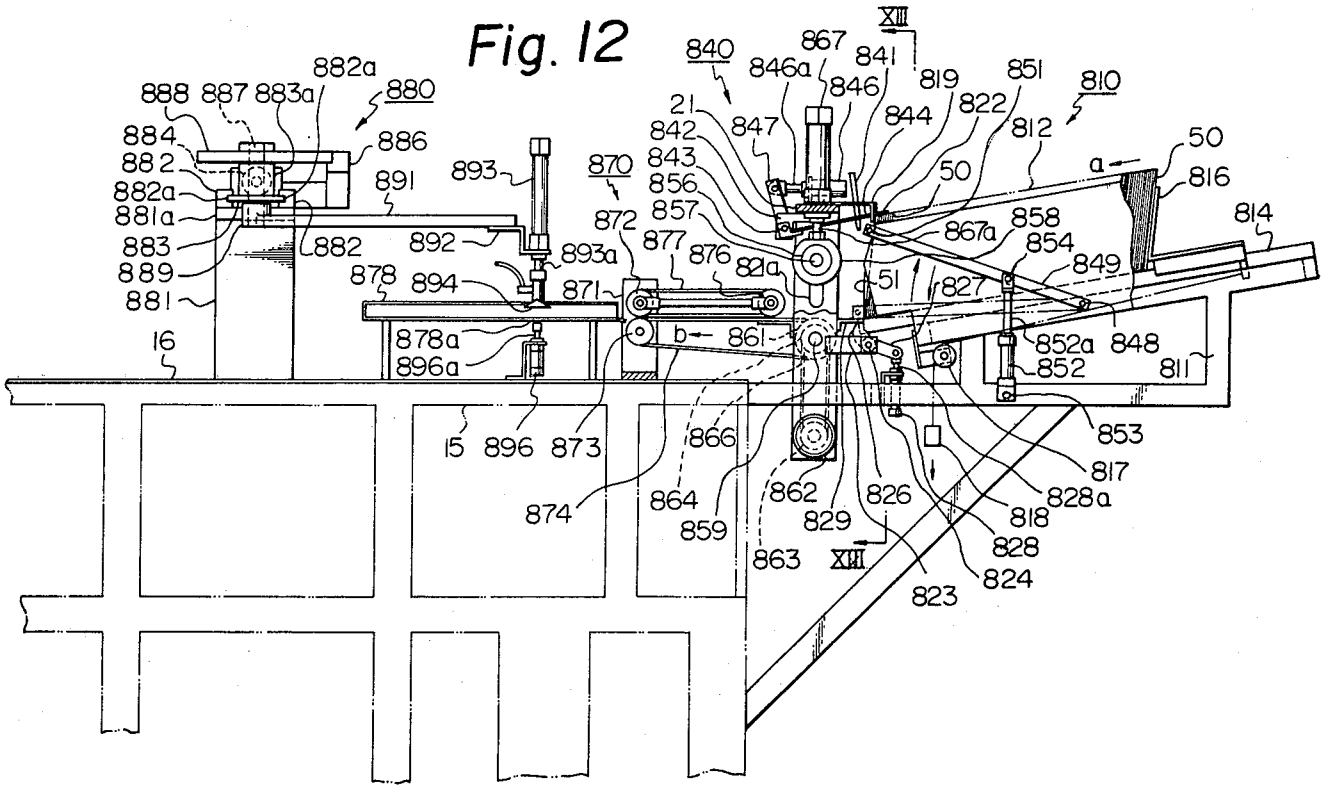
FIG. 12 is a front view of the insert feed assembly shown in FIG. 11.

In FIGS. 11 and 12, the insert feeder assembly 801 of this embodiment includes a reservoir mechanism 810 arranged on one end of the pedestal 15 and for reserving a number of folded insert in vertical state. The assembly 801 further includes a bending edge opener mechanism 840 for delivering each foremost folded insert from the reservoir mechanism 810 and open it flat. In cooperation with this opener mechanism 840, a feeder mechanism 870 feeds the flat insert to a prescribed stand-by position. The flat insert registered at the stand-by position is then caught by a catcher mechanism 880 and brought in position onto stockings S placed on the setting station 16*a*.

As shown in FIGS. 11 and 12, an insert support deck 811 is fixed to one side of the pedestal 15 and a pair of side boards 812 and 813 are mounted to the deck 811 whilst being spaced from each other in the direction of the slot 16*b* (see FIG. 1) in order to define a space for reserving a number of juxtaposed folded inserts in vertical state. As shown in FIG. 10, each insert is folded into three layers along the bending edges 54 and 56.

A pair of guide rails 814 extend in the longitudinal direction of the deck 811 so that a pusher plate 816 is reciprocal along the guide rails 814. A guide roller 817 is rotatably mounted sideways the deck 811 and a weight 818 is connected to the pusher plate 816 via the guide roller 817 so that the pusher plate 816 presses the group of the inserts forwards, i.e. in the direction shown with an arrow "a" in FIG. 11.

A stopper plate 819 is mounted to an upright gate-shaped bracket 821 mounted near the front end of the support deck 811 in order to hold the upper edge of the foremost insert in reservoir. More specifically, an L-shaped lifting limitter 822 is fixed to the end of the stopper plate 819 in order to block undesirable lifting of the next insert when the foremost insert should be delivered from the group. Bearings 823 are mounted to vertical legs of the bracket 821 in order to support a horizontal rotary shaft 824 on which rotary pawls 826 are radially fixed at their one ends. Further, a radial swing lever 827 is fixed at one end to the rotary shaft 824 and its the other end is linked to a piston rod 828*a* of an air cylinder 828 vertically mounted to the support deck 811.

As the air cylinder 828 operates to lift its piston rod 828*a*, the rotary pawls 826 are driven for counterclockwise turning in FIG. 12 via the elements 827 and 824 in order to sink from the top surface of a horizontal plate 829, thereby cancelling hold on the lower edge of the foremost insert 50 in reservoir.

The construction and operation of the bending edge opener mechanism 840 is as follows, reference being made to FIGS. 11 through 13. An air ejecting nozzle 841 is arranged almost vertically through the stopper plate 819 of the reservoir mechanism 810 with its mouth facing the first bending edge 54 of the foremost insert 50 in reservoir. As the air is blown under pressure by the nozzle 841, the first bending edge 54 of the formost insert is opened and its back cover section 51 is flattened of the horizontal plate 829 and a later described feed roller 861.

A bearing 842 is mounted beneath the horizontal section of the gate-shaped bracket 821 in order to carry a horizontal roatry shaft 843, which in turn carries a pair of mutually spaced pressor arms 844. The free end of the pressor arms 844 are located within recesses 819*a* formed in the stopper plate 819 right above the second bending edge 56 of the foremost insert 50 in reservoir. An air cylinder 846 is fixed horizontally to the top face of the bracket 821 and its piston rod 846*a* is linked to the rotary shaft 843 by means of an intermediate lever 847.

As the air cylinder 846 operates to withdraw its piston rod 846*a*, the pressor arms 844 turn clockwise in FIG. 2 via the elements 847 and 843 and presses down the second bending edge 56 of the foremost insert 50 in order to separate the back and front cover sections 51 and 52 from each other.

In the reservoir mechanism 810, a horizontal shaft 848 is arranged in a direction normal to the longitudinal direction of the support deck 811 and a pair of swing arms 849 are fixed at one ends to the shaft 848 at positions outside the side boards 812 and 813 in order to fixedly carry an opener rod 851 at their other ends. A vertical air cylinder 852 is pivoted at its bottom to the support deck 811 by means of a pin 853 and its piston rod 852*a* is pivoted to the body of one of the swing arms 849 by means of a pin 854.

As the air cylinder 852 operates to reciprocate its piston rod 852*a*, the opener rod 851 travels between the positions shown with solid and dott lines in FIG. 12 due to swing movement of the swing arms 849 about the shaft 848 in order to invade into the gap between the separated back and front cover sections 51 and 52 of the foremost insert 50.

Figure 13:
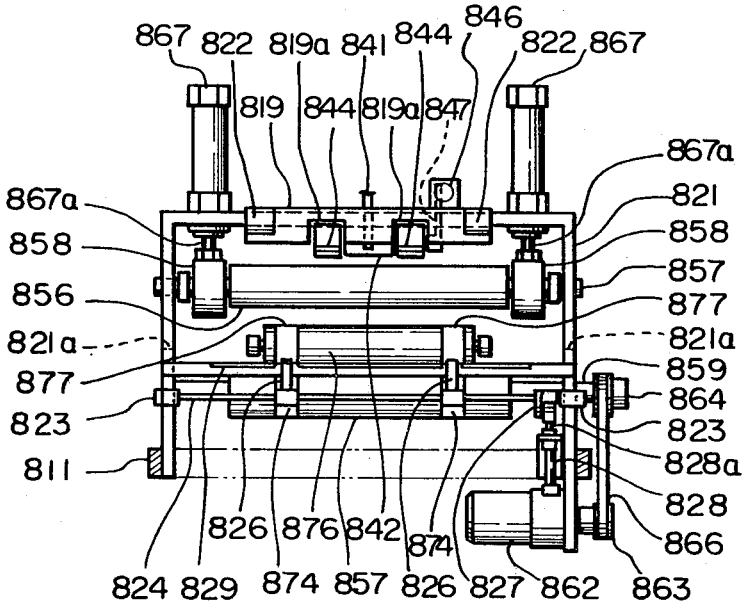
FIG. 13 is a view seen in the direction of arrows XIII in FIG. 12, FIGS. 14A through 14F are explanatory drawings for showing the overall operation of the assembly shown in FIGS. 11 and 12.

As shown in FIGS. 12 and 13, the both ends of a pressor roller 856 are received in grooves 821*a* formed in the vertical legs of the gate-shaped bracket 821 and coaxially coupled to a shaft 857 rotatably carried by a pair of bearings 858 fixed to the bracket 821. A horizontal shaft 859 is rotatably carried by the vertical legs of the bracket 821 in order to coaxially carry the feed roller 861 at a position somewhat below and parallel to the pressor roller 856. A drive motor 862 is horizontally fixed below the right leg (in FIG. 13) of the bracket 821 so that its output shaft carries a pulley 863. This pulley 863 is operationally related to a pulley 864 mounted to one end of the shaft 859 by means of a drive belt 866. A pair of air cylinders 867 are vertically mounted atop the bracket 821 with their piston rods 867*a* being coupled to the bearings 858 for the pressor roller 856.

After the drive motor 866 has operated to rotate the feed roller 861 counterclockwise in FIG. 2, the air cylinders 867 operate to advance their piston rods 867*a* and lowers the pressor roller 856 via the bearings 858 in order to press the back cover section 51 of the insert 50 onto the feed roller 861. Thus, the feed roller 861 delivers the foremost insert 50 whilst opening it flat from the reservoir mechanism 810 by its clockwise rotation in FIG. 2. For easy and smooth delivery of the insert 50, the pressor roller 856 is preferably covered with a friction resistant, highly abrasive peripheral layer such as a sponge roller sheath.

The feeder mechanism 870 is located in front of the gate-shaped bracket 821 in order to feed the delivered insert 50 to the prescribed position in an open, flat state. In FIGS. 11 and 12, a channel-shaped bracket 271 is mounted atop the table 16 and rotatably carries a pair of guide rollers 872 and 873 in vertical alignment. The lower guide roller 873 is operationally related to feed roller 861 of the opener mechanism 840 by means of a flat belt 874 whereas the upper guide roller 872 is operationally related to another guide roller 876 by means of a flat belt 877. Thus, the feeder mechanism 870 as a whole is given in the form of a belt conveyer.

Upon counterclockwise rotation of the feed roller 861 of the opener mechanism 840, the belts 874 and 877 run in the direction shown with an arrow "b" in FIG. 12 in order to feed, by their nip, the insert delivered by the opener mechanism 840 to a stand-by box 878 arranged next to thedownstream terminal of the belt conveyer in the open, flat state.

The catcher mechanism 880 is arranged on a horizontal section 881*a* of a stand 881 located near one rear corner of the table 16 as shown in FIGS. 11 and 12. A pair of horizontal, parallel guides 882 is fixed on the horizontal section 881*a* whilst extending in the longitudinal direction of the stand 881 and grooves 882*a* are formed in the facing surfaces of the guides 882. A slide plate 883 engages with the grooves 882*a* for reciprocal movement along the guides 882. An air cylinder 884 is horizontally mounted atop the framework 881*a* and its piston rod 884 is linked to the rear of the slide plate 883. A pinion rack 886 also extends on the section 881*a* in parallel to the guides 882. As the air cylinder 884 operate to reciprocate its piston 884*a*, the slide plate 883 is driven for reciprocal movement along the guides 882. A boss 883*a* is fixed to the front top of the slide plate 883 in order to rotatably carry a vertical shaft 887, which carries at its top a sector gear 888 in meshing engagement with the pinion rack 886 on the horizontal section 881*a*.

A sleeve 889 is fixedly inserted over the lower end of the vertical shaft 887, which in turn carries a radial, horizontal arm 891. An angled bracket 892 is fixed to the front end of the arm 891 in order to vertically carry an air cylinder 893 in an arrangement that its piston rod 893*a* is directed downwards. A suction mouth piece 894 is fixed to the free end of the piston rod 893*a* in order to provisionally catch by suction the insert standing by in the open, flat state in the stand-by box 878. To this end, another air cylinder 896 is mounted vertically on the table 16 in axial alignment with the air cylinder 893.

In operation, the air cylinder 896 operates to advance its piston rod 896*a* through a bottom hole 878*a* in the standby box 878 in order to locally lift the insert 50 placed in the stand-by box 878 and be caught by the mouth piece 894. Next the air cylinder 884 operates to withdraw its piston 884*a* and the slide plate 883 follows this movement along the guides 882. Then the sector gear 888 with the vertical shaft 887 rotates clockwise in FIG. 11 so that the arm 891 concurrently swings in the direction shown with an arrow "c" in FIG. 11 over 90 degrees. This turning of the arm 891 brings the insert 50 held by the mouth piece 894 from the stand-by position in the box 878 to the prescribed position on the stockings S placed under tension on the setting station 16*a*. Next, the air cylinder 893 operates to advance its piston rod 893*a* and the mouth piece 894 towards the stockings S and the suction on the mouth piece 894 is cancelled in order to deposit the insert on that prescribed position on the stocking S.

The overall operation of the insert feeder mechanism 801 in accordance with the second embodiment of the present invention will stepwise be explained in reference to FIGS. 14A through 14F.

Under the initial condition, the foremost insert 50 in folded state is kept in reservoir with its upper edge being held by the stopper plate 819 and the lower edge by the pair of pawls 826, the opener rod 851 is located near the upper front of the foremost insert 50, and the pressor roller 856 is located above and separate from the feed roller 861. Under this condition, the following automatic operation starts upon receipt of a control signal from the apparatus.

Figure 14A:
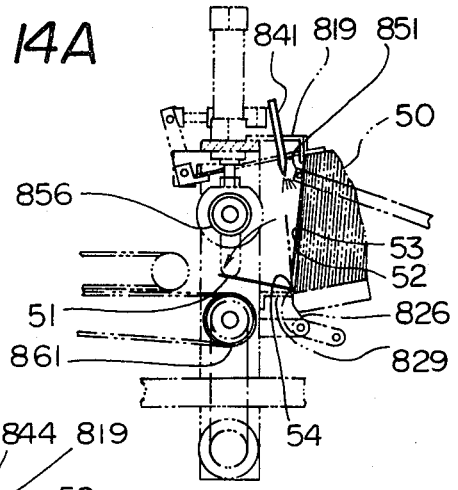

Air is blown under pressure by the nozzle 841 towards the foremost insert 50 in order to open its first bending edge 54 so that its back cover section 51 is spread over the horizontal plate 829 and the feed roller 861 as shown in FIG. 14A.

Figure 14B:
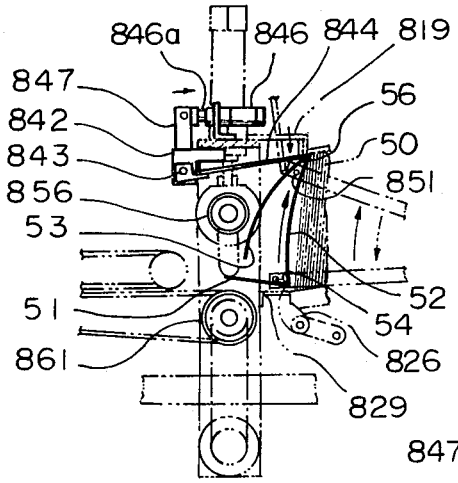

Next, the pair of pressor arms 844 turn clockwise in FIG. 12 with the rotary shaft 843 due to operation of the air cylinder 846 so that their front ends slightly press down the second bending edge 56 in order to separate the insert and front cover sections 53 and 52 from each other as shown in FIG. 14B.

Figure 14C:
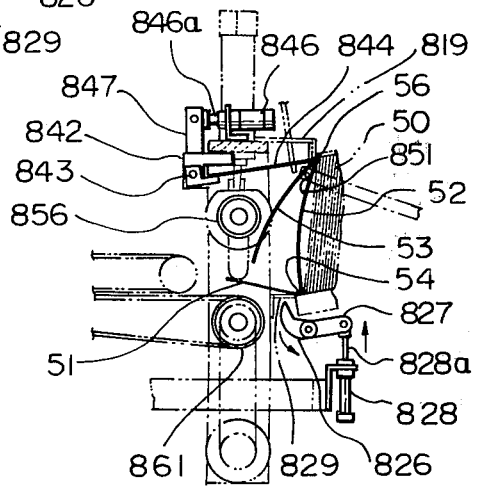

Concurrently with this movement, the opener rod 851 is driven for reciprocation between the positions shown with the solid and dott lines in FIG. 12 by operation of the air cylinder 852 in order to slip into a gap between the back and front sections 51 and 52 of the insert 50 as shown in FIGS. 14B and 14C. At this moment, the pair of pawls 826 swing counterclockwise with the shaft 824 as shown in FIG. 14C in order to relieve the hold on the insert 50.

Figure 14D:
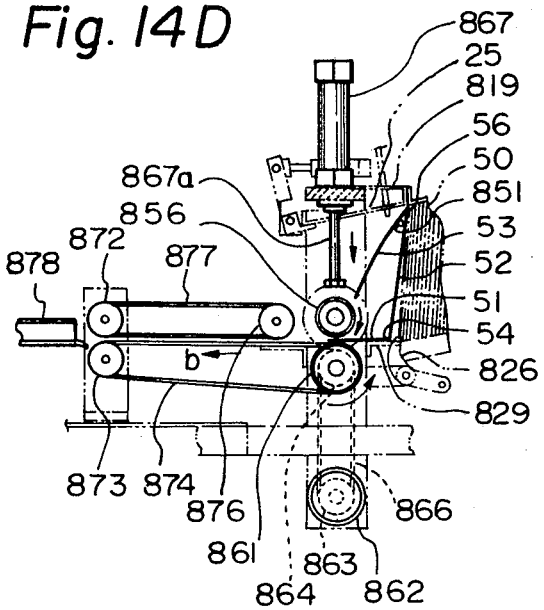

Next, the pressor roller 856 comes down on the feed roller 861 by operation of the air cylinders 867 so that the back cover section 51 of the partly open insert 50 should be nipped between the rollers 856 and 861 as shown in FIG. 14D. Substantially in synchronism with this lowering of the pressor roller 856, the drive motor 862 is driven for rotation and rotates the feed roller 861 in the direction of an arrow shown in FIG. 14D in order to cause simultaneous rotation of the pressor roller 856. The combined rotation of the rollers 861 and 856 delivers the back cover section 51 towards the feeder mechanism 870 whilst fully spreading the insert 50.

Since the pressor roller 856 is peripherally covered with a friction-resistant, highly abrasive material layer, the above-described delivery of the insert 50 can be performed quite easily. Further, since the opener rod 851 intervenes between the front cover and insert sections 52 and 53, the second bending edge 56 can be flattened without fail when the insert 50 is delivered. During this delivery of the foremost insert 50, the above-described rotary pawls 826 resume their initial positions in order to block falling of the succeeding inserts 50 from the reservoir mechanism 810.

The flat, opened insert 50 from the opener mechanism 840 is then passed over into a nip by the flat belts 874 and 877 which are running in the direction of the arrow "b" in FIG. 12 and further into the stand-by box 878 located at the down-stream terminal of the belt conveyer. The insert 50 in the stand-by box 878 is then brought in position on the stockings S by the catcher mechanism 880.

Figure 14E:
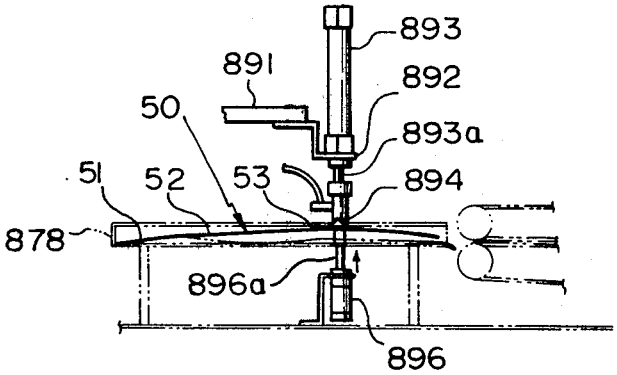

First, the air cylinder 896 operates to advance the piston rod 896*a* upwards in order to locally lift the open insert 50, more specifically the insert section 53, so that it is caught by the suction mouth piece 894 as shown in FIG. 14E. Next, the air cylinder 884 operates to move the slide plate 883 backwards along the guides 882 in order to cause a 90 degrees rotation of the arm 891 in the direction "c" in FIG. 11 due to the meshing engagement between the sector gear 888 and the pinion rack 886. By the rotation of the arm 891, the open insert 50 in the stand-by box 878 is brought in position onto the stockings placed on the setting station 16*a*, more specifically to the middle of the leg sections of the stockings S. Next, the suction mouth piece 894 is lowered over a prescribed distance and suction working thereon is cancelled in order to deposit the open insert 50 on the stockings S so that its insert section 53 is located on the middle of the leg sections as shown in FIG. 14F.

Figure 14F:
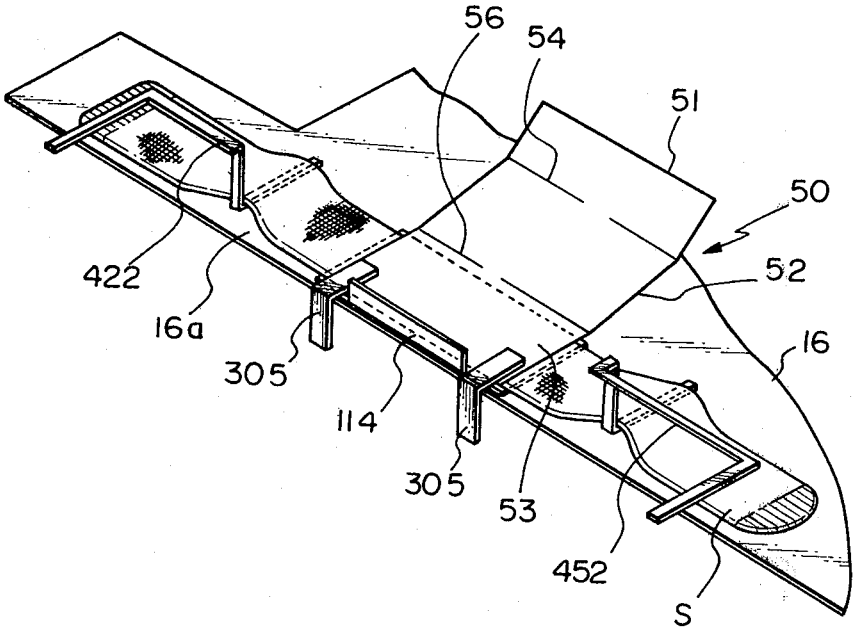

In the condition shown in FIG. 14F, the stockings S and the insert 50 are held in position by combined operation of a grip plate 114, gripper plates 305 and folder bars 422 and 452 just as in FIG. 9F for the first embodiment.

Figure 15:
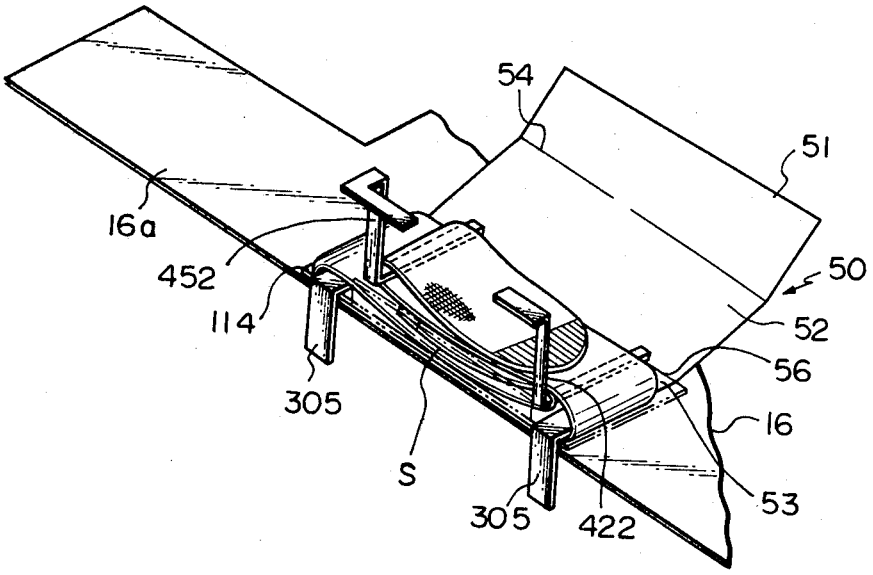
FIG. 15 is a perspective view of the stockings folded around the foldable insert shown in FIG. 10.

After the insert 50 in the fully open state is placed on the middle of the leg sections of the stockings S placed in the setting station 16*a*, the gripper plates 305 provisionally grip the insert section 53 of the insert 50 and the stockings S together, and the folder bars 422 and 452 move toward each other in order to simultaneously fold the waist and leg sections of the stockings S about the insert section 53 of the insert 50 as shown in FIG. 15.

Figure 16:
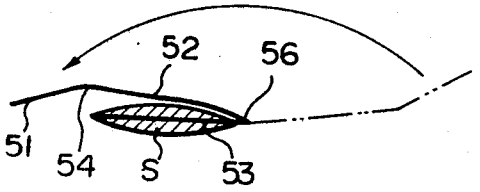
FIG. 16 is a side view of the stockings with the insert partly folded therearound.
Figure 17:
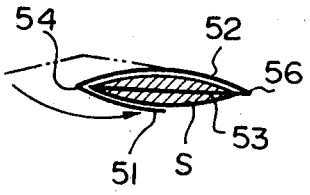
FIG. 17 is a side view of the stockings with the insert fully folded thereabout.

Thereafter, the stockings S in the folded state are brought to the position in line with an envelope standing by the grip plate 114. During this transportation, the front cover section 52 is first folded on the stockings S in the folded state as shown in FIG. 16, and the back cover section 51 is next folded about the stockings S as shown in FIG. 17. Thus, the stockings with the insert are now ready for packaging into the envelope waiting at the stand-by position.

In the case of the foregoing embodiments, stockings have to be manually placed in position on the transfer plate 105 in the setting station 16*a* by an operator standing in front of the apparatus, and the automatic operation starts thereafter. Correct positioning of the stockings requires highly skilled technique and relatively long time for supply of the stockings. Further, only after supply of the first stockings is complete, supply of the next stockings is allowed to start. These cause low efficiency in entire processing resulting in high production cost which can otherwise be avoided. In addition, repeated lateral reciprocation of the pair of folder bars over the setting station tends to endancer the operators involved in supply of the stockings in position on the setting station.

The third embodiment of the apparatus in accordance with the present invention is therefore provided with a stockings feeder assembly 901 which is capable of supplying stockings in an automatic fashion.

Figure 18:
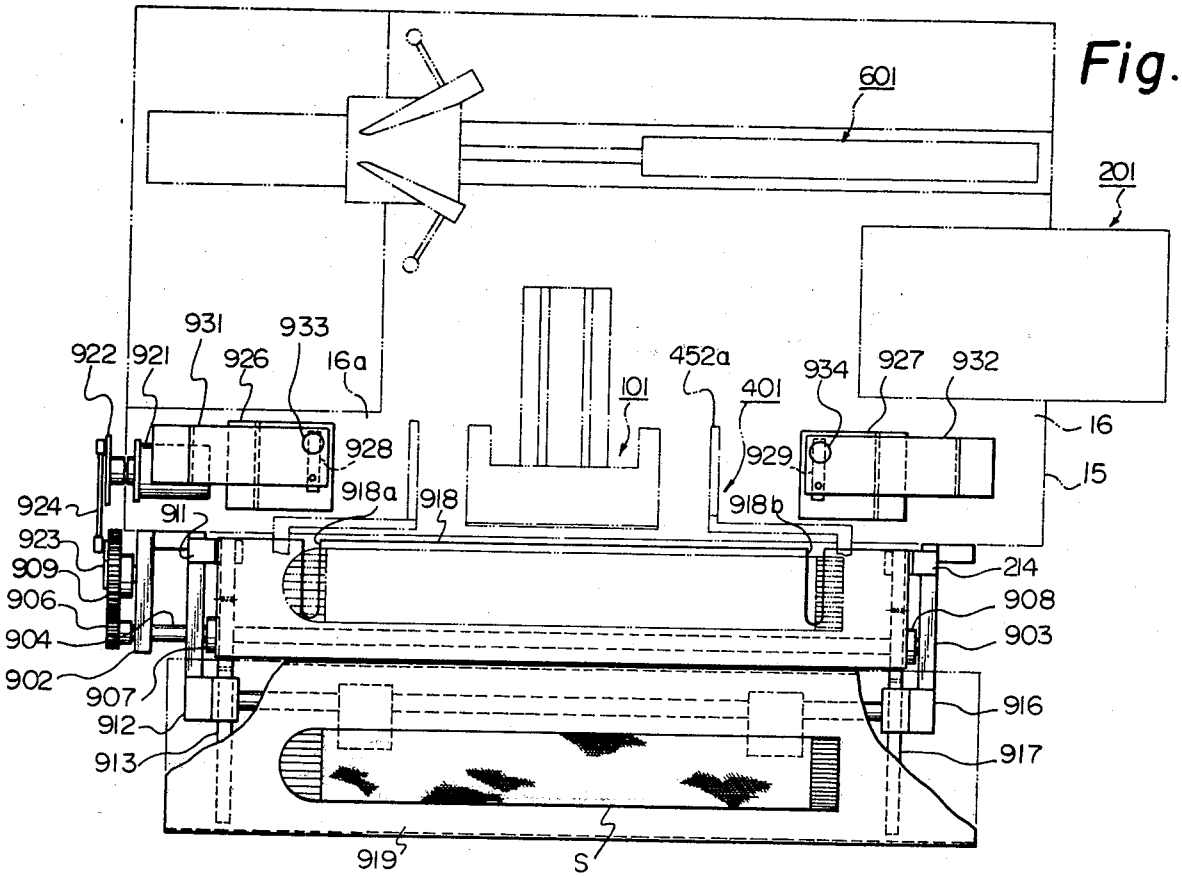
FIG. 18 is a top view of the third embodiment of the apparatus of the present invention provided with an automatic stockings feeder assembly.
Figure 19:
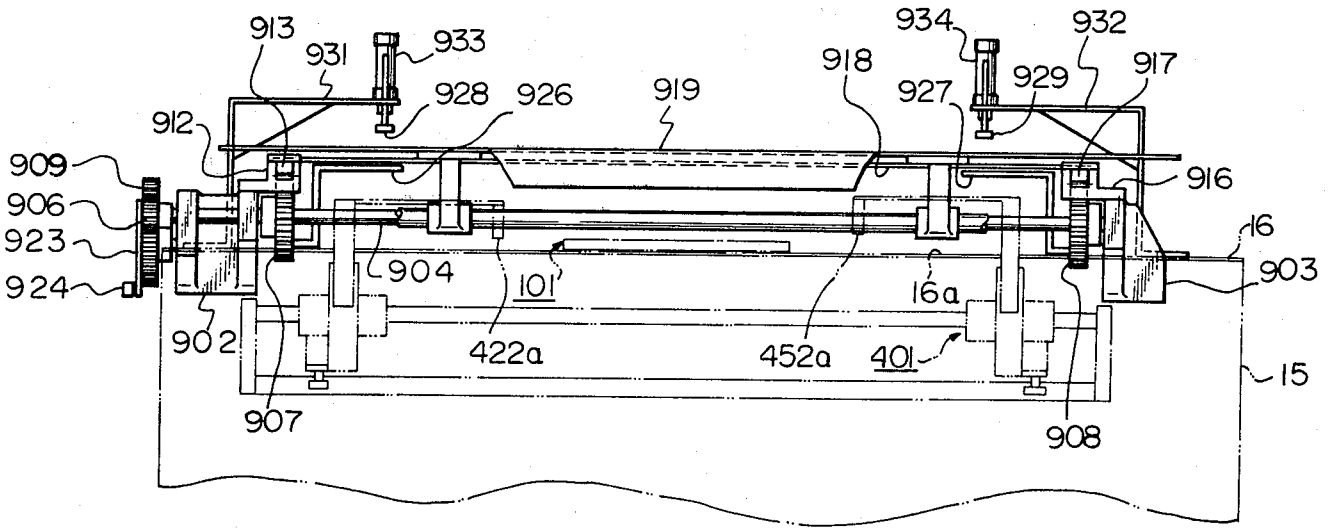
FIG. 19 is a front view of the stockings feeder assembly shown in FIG. 18, FIGS. 20 and 21 are right and left side views of the assembly shown in FIG. 18.
Figure 20:
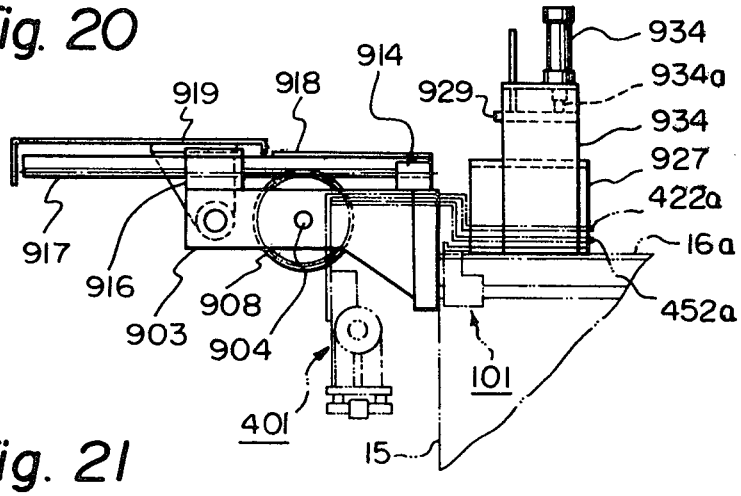

Like the foregoing embodiments, the apparatus shown in FIG. 18 includes the table 16 arranged on the pedestal 15, the transfer assembly 101, the insert feeder assembly 201, the insert gripper assembly 301, the stockings folder assembly 401, the conveyor assembly 501 and the stockings encloser assembly 601. Packaging of stockings into inserts is carried out by means of sequentially combined operation of these assemblies whose constructions are substantially the same as those of the foregoing embodiments.

The stockings feeder assembly 901 of this embodiment includes a pair of bearing brackets 902 and 903 fixed to both ends of a front side framework of the pedestal 15, which in turn turnably carry a horizontal rotary shaft 904 extending in a direction normal to the longitudinal direction of the slot 16*b* in FIG. 1. The rotary shaft 904 fixedly carries three wheels 906, 907 and 908. The left end gear 906 is in meshing engagement with a drive gear 909. A pair of brackets 911 and 912 are mounted atop to both longitudinal ends of the left side bearing bracket 902 and a pinion rack 913 slidably engages with the brackets 911 and 912 whilst extending in a direction normal to the rotary shaft 904. This pinion rack 913 is in meshing engagement with the intermediate gear 907. Likewise, a pair of brackets 914 and 916 are mounted atop to both longitudinal ends of the right side bearing bracket 903 and a pinion rack 917 slidably engages with the brackets 914 and 916 whilst extending in a direction parallel to the left side pinion rack 913. This pinion rack 917 is in meshing engagement with the right end gear 908.

A stockings feed plate 918 is horizontally carried at both lateral ends by the pinion racks 913 and 917 so that the feed plate 918 shift forwards and backwards as the pinion racks 913 and 917 reciprocate. A mounting station 919 for reserving a number of stockings S is arranged in front of the feed plate 918.

Figure 21:
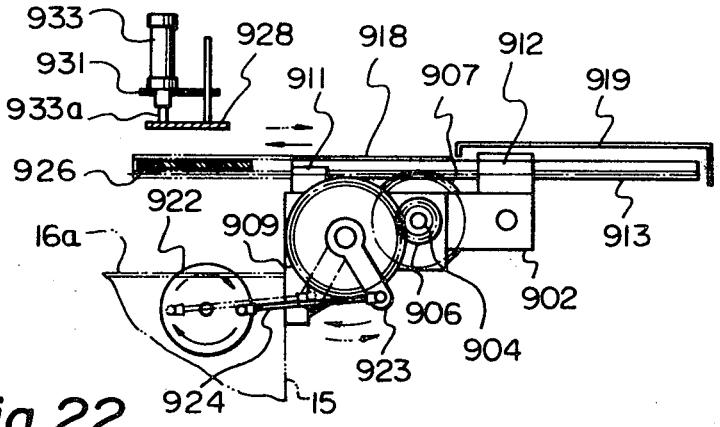

An intermittent drive motor 921 is mounted to a left-side framework of the pedestal 15 behind the bearing bracket 902 and a disc 922 is fixed to its output shaft as shown in FIG. 21. The above-described drive gear 909 is accompanied in one body with a radial arm 923 which is linked at its outer end to one peripheral point on the disc 922 by means of a connecting rod 924. Thus, one rotation of the drive motor 921 causes one reciprocal swing movement of the arm 923, and naturally one reciprocal rotation of the drive gear 909.

That is, as shown in FIG. 21, the first half rotation of the drive motor 921 accompanies one half rotation of the disc 922 in a direction shown with an arrow "a", and the radial arm 923 on the drive gear 909 shifts from the position shown with solid lines to that with chain lines. The next half rotation of the drive motor 921 causes the radial arm 923 to return from the position shown with the chain lines to that with the solid lines. Such a reciprocal movement of the radial arm 923 results in simultaneous reciprocal rotation of the drive gear 909 over prescribed angles.

The first clockwise rotation of the drive gear 909 in FIG. 21 accompanies counterclockwise rotation of the left end gear 906 with the rotary shaft 904 and the pinion racks 913 and 917 in meshing engagement with the gear 906 shift rearwards in order to move the feed plate 918 away from the mounting station 919. The next counterclockwise rotation of the drive gear 909 in FIG. 21 accompanies clockwise rotation of the left end gear 906 with the rotary shaft 904 and the pinion racks 913 and 917 shift forewards in order to move the feed plate 918 towards the mounting station 919. Consequently, if stockings S are mounted in tension to the fed plate 918, the above-described reciprocal movement of the feed plate 918 brings the stockings S in position on the setting station 16*a* on the table 16.

Figure 22:
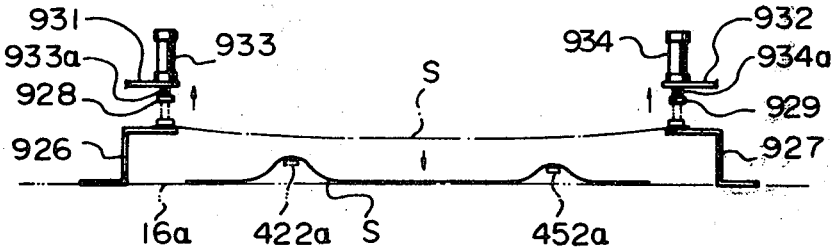
FIG. 22 is a simplified front view of the assembly for showing its operation.

As better seen in FIGS. 18 and 22, a pair of Z-shaped stands 926 and 927 are mounted to the table 16 near its lateral ends positions somewhat behind the feed plate 918 and provided with pressors 928 and 929 for the stockings S. Brackets 931 and 932 are arranged above the stands 926 and 927 and support vertically arranged air cylinders 933 and 934, respectively. Piston rods 933*a* and 934*a* are coupled to the pressors 928 and 929, respectively.

As the air cylinders 933 and 934 operate to advance their piston rods 933*a* and 934*a*, the pressors 928 and 929 lower through slots 918*a* and 918*b* in the feed plate 918 in order to press both ends of the stockings S against the top surfaces of the stands 926 and 927 and provisionally hold same in tension. Then, the feed plate 918 returns to its initial position so that the stockings S only are left at the position where they are pressed against the stands 926 and 927. Next, the pressors 928 and 929 relax their hold on the stockings S which fall by their own weight in position onto the setting station 16*a*.

Operation with the stockings feeder assembly 901 in accordance with the present embodiment develops as follows. Stockings S are piled up on the apparatus takes the uppermost one from the pile in order to put same in tension to the correct position on the feed plate 918. The automatic operation starts thereafter.

By the first half rotation of the drive motor 921, the feed plate 918 carries the stockings S to the prescribed position on the setting station 16*a*. Slightly before this transportation for example 0.1 to 0.2 seconds before this transportation, the air cylinders 933 and 934 are driven for operation to advance their piston rods 933*a* and 934*a*. Upon arrival of the stockings S at the above-described position, the pressors 928 and 929 press the both ends of the stockings S against the stands 926 and 927 in order to provisionally hold same in tension. During the next half rotation of the drive motor 921, the feed plate 918 returns to its initial position close to the mounting station 919 whilst passing over the stockings S to the hold by the pressors 928 and 929. Next, the air cylinders 933 and 934 operate to withdraw their piston rods 933*a* and 934*a* in order to relax the hold on the stockings S by the pressors 928 and 929 and the stockings S fall in position on the setting station 16*a* for subsequent folding and packaging.

In accordance with the present embodiment, the only manual operation required is to shift the uppermost stockings from the pile on the mounting station onto the prescribed position on the feed plate and the subsequent operation is carried out fully automatically. This provides great safety for operation by the operator. In addition, the manual operation for supply of stockings onto the feed plate can be carried out concurrently with the automatic folding operation of the preceding stockings and such a concurrent process greatly raises efficiency in operation, thereby causing remarkable lowering in the munufacturing cost.

In the case of the foregoing embodiments, stockings folded around a cardboard insert is enclosed in an envelope of thermoplastic, transparent material and each envelope is sealed by manual operation. That is, the flap of the envelope enclosing the stockings is folded is folded over and a gummed tape is applied in order to hold the flap down. Such manual work form a bottleneck in streamlining the whole operation and, therefore, causes rise in the production cost.

The fourth embodiment of the apparatus in accordance with the present invention contemplates automatic sealing of the envelopes enclosing stockings and is provided with an envelope sealing assembly.

The envelope sealing assembly 1001 of this embodiment includes a conveyor mechanism for transporting envelopes enclosing stockings, a reversing mechanism for reversing the position of each envelope falling aff the conveyor mechanism, a transporting mechanism for holding and transporting each envelope to the next station, a sealing mechanism for folding over the flap of the envelope and applying a gummed tape in order to hold flap down, and a deliverying mechanism for piling up a prescribed number of sealed envelopes for subsequent delivery.

Figure 23:
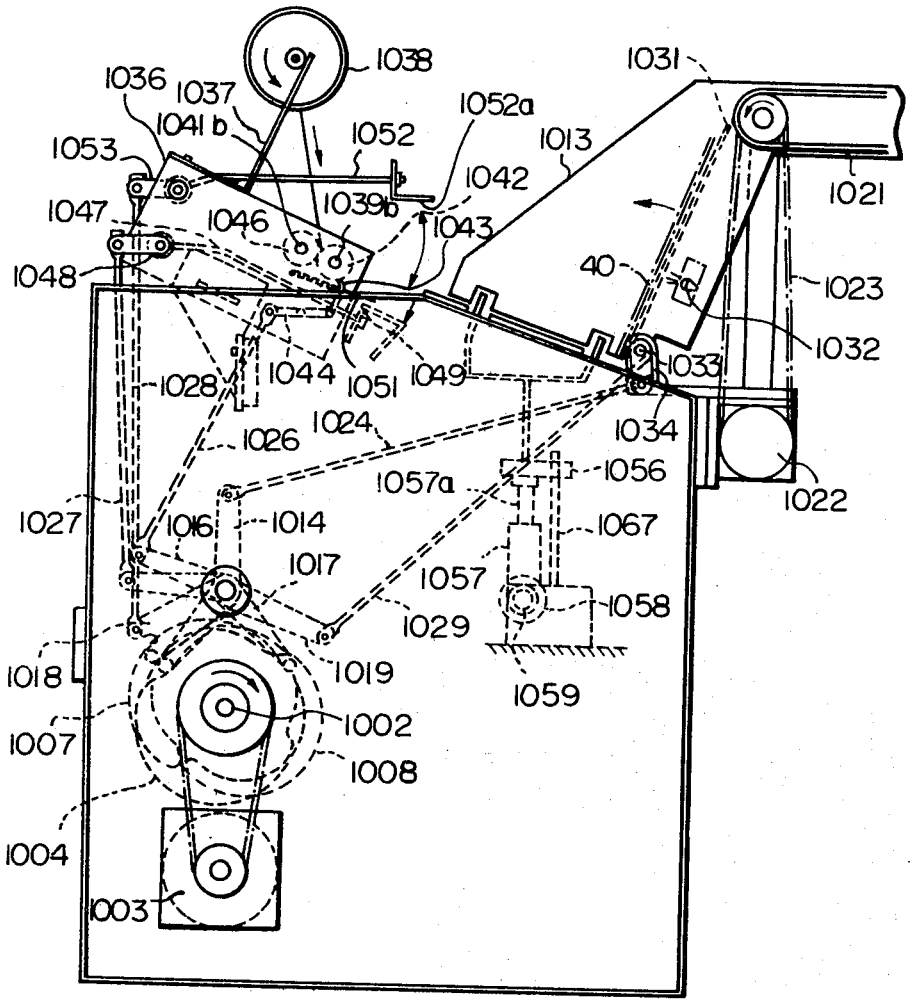
FIG. 23 is a right side view of the fourth embodiment of the apparatus of the present invention provided with an automatic envelope sealing assembly.
Figure 24:
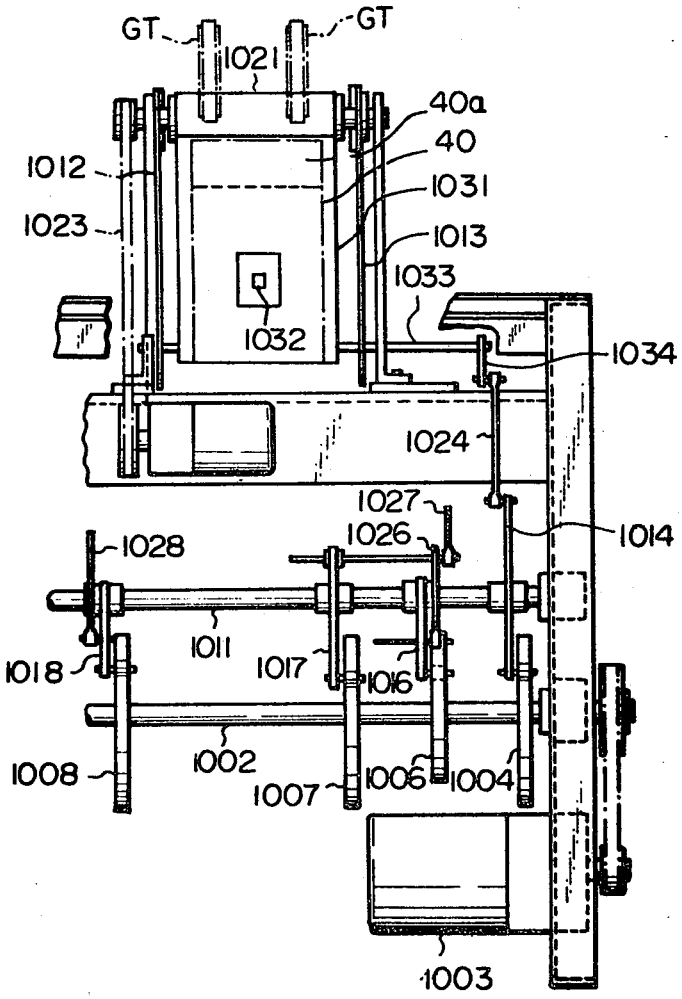
FIG. 24 is a front view, partly omitted, of the apparatus shown in FIG. 23.
Figure 25:
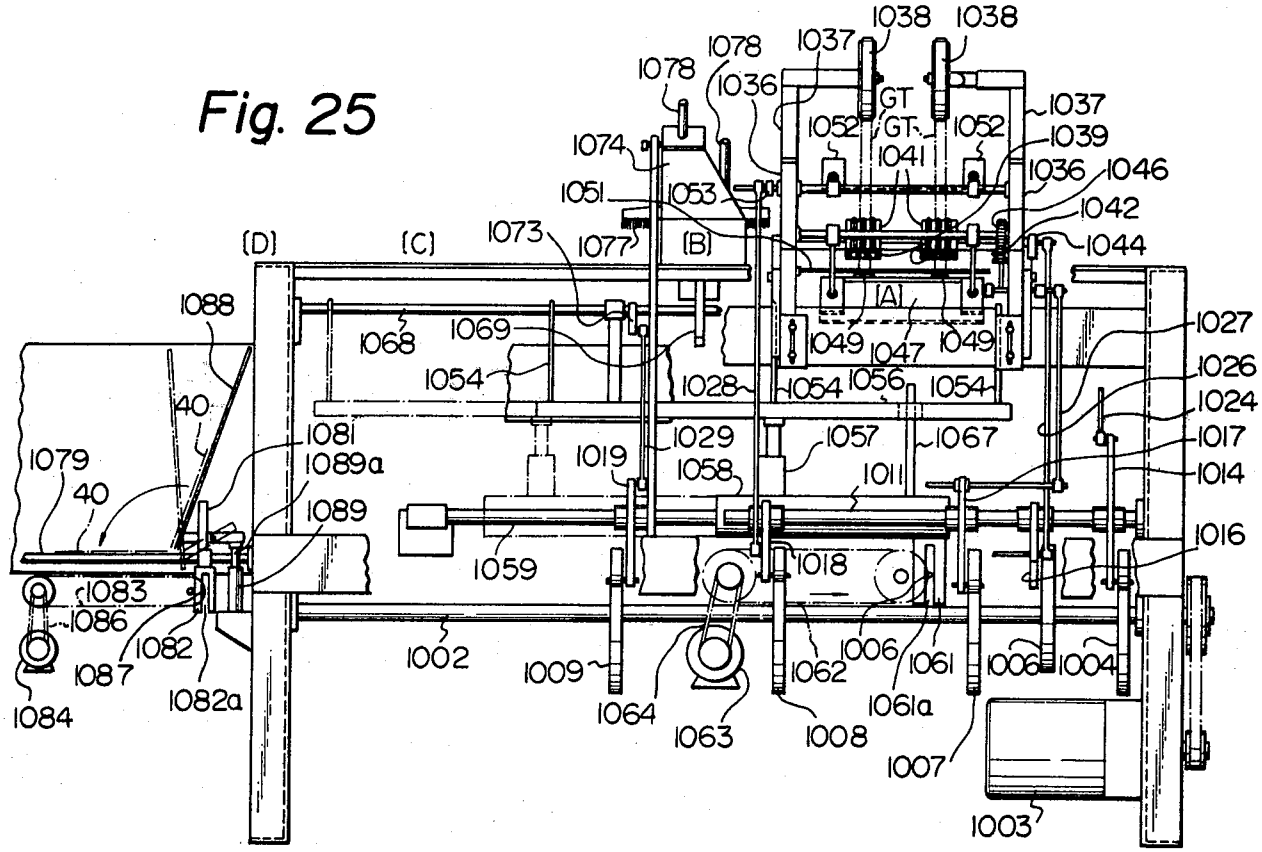
FIG. 25 is a front view of the apparatus shown in FIG. 23.

In FIGS. 23 through 25, a rotary shaft 1002 is horizontally mounted to a framework of the pedestal 15 and operationally related to a drive motor 1003 by means of a known belt-drive system. Five cams 1004, 1006, 1007, 1008 and 1009 are fixedly mounted to the shfat 1002 in spaced relationship to each other. Another rotary shaft 1011 is arranged above and in parallel to the rotary shaft 1002. This shaft 1011 fixedly carries a first swing arm 1014 related in operation to the first cam 1004, a second swing arm 1016 to the second cam 1006, a third swing arm 1017 to the third cam 1007, a fourth swing arm 1018 to the fourth cam 1008, and a fifth swing arm 1019 to the fifth cam 1009. The first swing arm 1014 is accompanied with a first connecting rod 1024, the second swing arm 1016 with a second connecting rod 1026, the third swing arm 1017 with a third connecting rod 1027, the fourth swing arm 1018 with a fourth connecting rod 1028, and the fifth swing arm 1019 with a fifth connecting rod 1029.

A horizontal conveyer belt 1021 is driven for rotation by a drive motor 1022, which is fixed to the pedestal 15, by means of a vertical drive belt 1023, and is supported by a pair of stands 1012 and 1013 mounted atop the pedestal 15. A skew reversing plate 1031 is pivoted to extends between the stands 1012 and 1013.

A photo-electric sensor 1032 is arranged behind the reversing plate 1031 and, via a suitable known signal processing circuit, electrically connected to the drive motor 1003 so that the drive motor 1003 should be driven for rotation when the sensor 1032 detects presence of an envelope 40 on the reversing plate 1031. A horizontal shaft 1033 is fixed about the bottom of the reserving plate 1031 (see FIG. 24) and an arm 1034 fixedly mounted to one end of the shaft 1033 is operationally coupled to the first cam 1004 by means of the elements 1014 and 1024.

As the drive motor 1033 rotates upon detection of an envelope 40 on the reversing plate 1031 by the sensor 1032, the first cam 1004 rotates with the shaft 1002 and moves the reversing plate 1031 in the direction of the arrow in FIG. 23 via the elements, 1014, 1024, 1034 and 1033 in order to push down the envelope 40 on the frame surface so that its flap 40*a* (see FIG. 6A) should be located on the underside.

Figure 27:
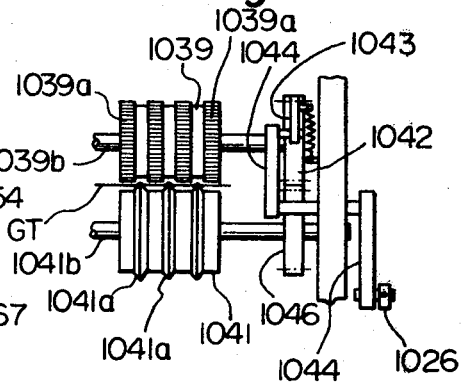
FIG. 27 is an enlarged view of the mechanism for delivering a gummed tape used for sealing the envelopes.

A pair of stands 1036 are mounted to the frame on which L-shaped brackets 1037 are mounted, respectively, as better seen in FIG. 25. Rolls of gummed tapes 1038 are freely rotatably carried by the ends of the brackets 1037 and drive rollers 1039 each having axially spaced lines 1039*a* of surface grooves running its axial direction are horizontally and rotatably carried by and between the pair of stands 1036 by means of a drive shaft 1039*b* at positions under the gummed tape rolls 1038. Each drive roller 1039 is accompanied with a parallel driven roller 1041 arranged between the stand 1036 by means of a driven shaft 1041*b* and having sharp flanges 1041*a* engaging the spaces between adjacent surface groove lines 1039*a*. The gummed tape rolls 1038 are mounted to the brackets 1037 so that adhesive surfaces of gummed tapes GT delivered from the rolls 1038 come in contact with the sharp flanges 1041*a* as shown in FIG. 27. The drive shaft 1039*b* fixedly carries a gear 1042 which is in engagement with a ratchet 1043 carried by the second connecting rod 1026 by means of an arm 1044. The driven shaft 1041*b* fixedly carries a gear 1046 in meshing engagement with the gear 1042 on the drive shaft 1039*b*.

As the second cam 1006 rotates, the ratchet 1043 intermittently rotates the drive and driven rollers 1039 and 1041 in order to intermittently deliver the gummed tapes GT from their rolls 1038.

A pair of swing lever 1047 is rotatably mounted to the stands 1036 and operationally linked to the third connecting rod 1027 by means of an arm 1048. Each swing lever 1047 carries a cutter 1049 for severing a gummed tape GT delivered by the rollers 1039 and 1041 and held by a bar 1051. At positions over the swing levers 1047, a pair of swing levers 1052 are pivoted to the stand 1036, each having a pressor surface 1052*a* to contact the corresponding cutter 1048. These swing levers 1052 are linked to the fourth connecting rod 1028 by means of an arm 1053.

As the fourth cam 1008 rotates, the swing levers 1052 are driven for swing movement in order to sever, in cooperation with the cutters 1048, the gummed tapes GT sticking to the back surface of the flap 40*a* to a prescribed length.

Three substantially Y-shaped engage rods 1054 are fixed upright to a support block 1056 which is mounted atop a piston rod 1057*a* of an air cylinder 1057. This air cylinder 1057 is fixed to a sleeve 1058 slidable inserted over a support shaft 1059 which extends in parallel to the rotary shaft 1002 for the cams. A hook piece 1061 is fixed to one end of the sleeve 1058 whilst extending downwards and provided with a recess 1061*a*. An endless chain 1062 is arranged horizontally, as better seen in FIG. 25, and driven for running by a drive motor 1063 by means of a chain 1064. A projection 1066 is fixed to one link of the endless chain 1062 and loosely received within the recess 1061*a* of the hooking piece 1061.

As the motor 1063 drives the endless chain 1062 for running, the sleeve 1058 is forced to move along the support shaft 1059 with the hook piece 1061. A guide rod 1067 is arranged vertically on a framework for stable vertical movement of the support block 1056.

Figure 26:
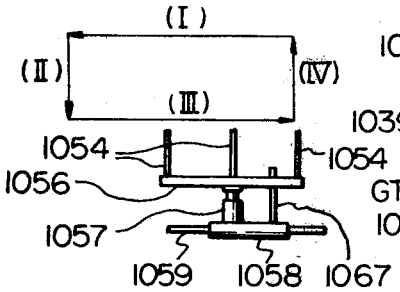
FIG. 26 is an explanatory view for showing the operation of the envelope sealing assembly.

The movement of the engage rods 1054 to be caused by the running of the endless chain 1062 is shown in detail in FIG. 26. First, running of the endless chain 1062 causes the engage rod 1054 to travel horizontally leftwards whilst projecting over the top face of the frame. This is referred to "the first process I". Next, as the air cylinder 1057 withdraws its piston rod 1057*a*, the engage rods 1054 submerge under the top face of the frame, this being referred to "the second process II". Further running of the endless chain 1062 now caused the engage rods 1054 to travel horizontally but rightwards under the top face of the frame. This is called "the third process III". Finally, the air cylinder 1057 advances its piston rod 1057*a* in order to return the engage rods 1054 to their initial position, this being referred to "the fourth process IV".

The envelope 40 with a flap 40*a* carrying two gummed tapes GT is placed on the top face of the frame at a position between the two right side engage rods 1054. This position is marked "A" in FIG. 28.

Figure 28:
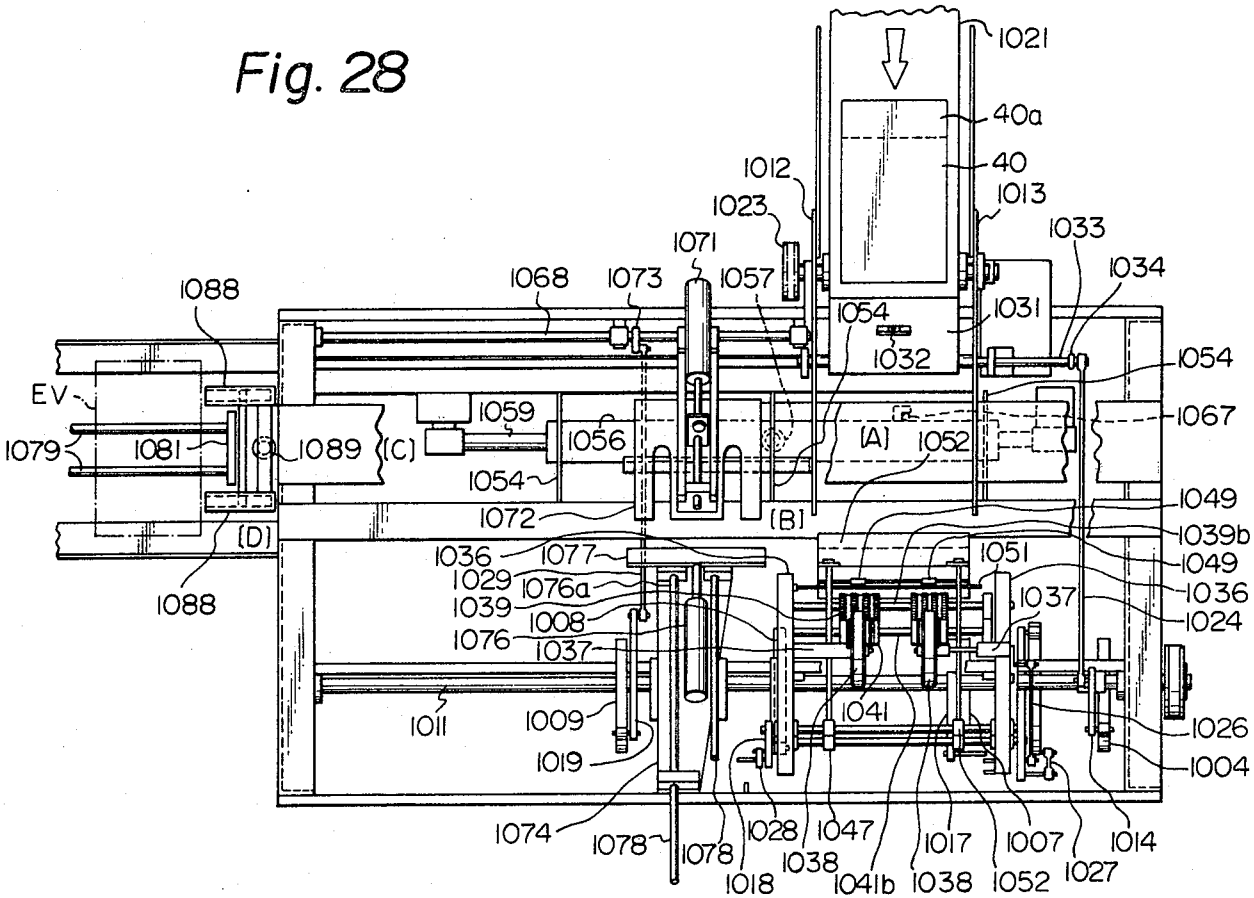
FIG. 28 is a plan view of the apparatus shown in FIG. 23.

As the engage rods 1054 travel leftwards during the above-described first process I, the envelope 40 slides in the same direction on the top face over the distance equal to the interval between the adjacent engage rods 1054 and arrives at a position marked "B" in FIG. 28.

Figure 29:
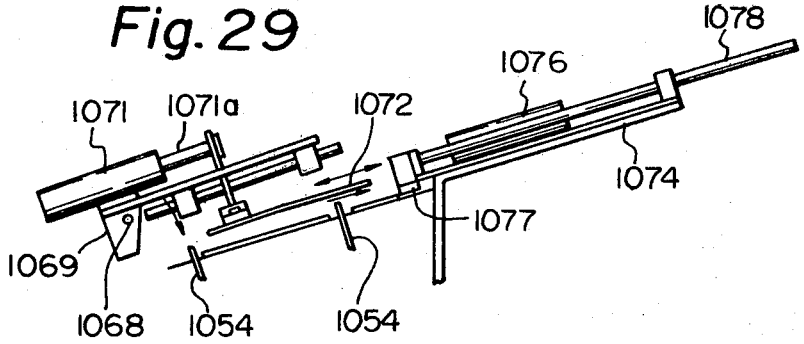
FIG. 29 is an enlarged side view of the mechanism for sealing the flaps.

A horizontal shaft 1068 is rotatably arranged on the frame in parallel to the rotary shaft 1002 and fixedly carries, near the position B, a bracket 1069 which in turn fixedly carries a skew air cylinder 1071 as shown in FIG. 29. A pressor plate 1072 is fixed to a piston rod 1071*a* of the air cylinder 1071 in order to press the envelope 40 in the position B. An arm 1073 is fixed to the shaft 1068 and linked to the fifth cam 1009 by means of the elements 1029 and 1019.

As the fifth cam 1009 on the rotary shaft 1002 rotates, the pressor plate 1072 is driven for movement towards and away from the envelope 40 in the position B.

In the position B, a further bracket 1074 is fixed on the frame whilst facing the pressor plate 1072 as better seen in FIG. 29 in order to fixedly support a skew air cylinder 1076. A brush unit 1077 is fixed to a piston rod 1076*a* of the air cylinder 1076 so that it is shiftable, as the air cylinder 1076 operates, to a position overhead the pressor plate 1072. Guide rods 1078 extend rearwards from the brush unit 1077 and slidably supported by a suitable bracket mounted to the frame for stable movement of the brush unit 1077.

This brush unit 1077 is used for folding over the flap 40*a* carrying the gummed tapes GT in order to seal the open mouth of the envelope 40 in the position B.

After the sealing is over, the sealed envelope 40 is then carried further leftwards by the movement of the engage rods 1054 in the first process I shown in FIG. 26. This position is marked "C" in FIG. 28. By this movement of the newly sealed envelope 40 to the position C, the preceding sealed envelope 40 in the position C is pushed to a downstream position which is marked "D" in FIG. 28.

At an outer position below the top face of the frame, a pair of receiver rods 1079 are arranged whilst extending horizontally in the moving direction of the envelope 40. The receiver rods 1079 slidably supports a pusher 1081 which is accompanied at the bottom with a hook piece 1082 having a recess 1082*a* opening downwards. An endless chain 1083 is arranged horizontally below the receiver rods 1079 and driven for running by a reversible motor 1084 via a chain 1086. A projection 1087 is formed on one link of the endless chain 1083 in engagement with the recess 1082*a* in the hook piece 1082.

Reversible rotation of the motor 1084 drives the pusher 1081 for reciprocal sliding along the receiver rods 1079.

A pair of bent reverting straps 1088 are arranged close to both sides of pusher 1081 with their top ends being located close to the side face of the frame. An air cylinder 1089 is vertically mounted to the frame and its piston rod 1089*a* is coupled to the lower ends of the reversing straps 1088 so that the reversing straps 1088 are tiltable upon operation of the air cylinder 1089. The envelope 40 falling down from the top face of the frame leans against the reversing straps 1088 which is in turn urged by the air cylinder 1089 to swing forwards in order to turn down the envelope 40 onto the receiver rods 1079 and, after a prescribed number of envelopes 40 are piled up on the rods 1079, the pusher 1081 advances in order to dischange the pile of the envelopes 40.

With the above-described construction, the apparatus of the present embodiment operates as follows.

As each envelope 40 enclosing stockings S arrives at the downstream terminal of the conveyer belt 1021, it falls on the reversing plate 1031 and the sensor 1032 detects its presence in order to initiate rotation of the motor 1003, i.e. the cam shaft 1002.

Rotation of the first cam 1004 causes, via the elements 1014 and 1024, forward turning of the reversing plate 1031 in order to lay the envelope 40 on the top face of the frame with its flap 40*a* being located on the underside facing the gummed tapes GT. This occurs at the position A.

Rotation of the second cam 1006 delivers, via the elements 1016 and 1926, the pair of gummed tapes GT over the prescribed through the nip between the rollers 1039 and 1041.

Rotation of the third cam 1007 induces, via the elements 1017 and 1027, upward swing movement of the swing lever 1047. Concurrent rotation of the fourth cam 1008 causes, via the elements 1018 and 1028, downward swing movement of the swing lever 1052. By such combined movements, the flap 40*a* is place under pressure nip, leading ends of the gummed tapes GT are pressed against the flap, and are severed by the cutter 1049 at positions projecting from the end of the flap 40*a* over a prescribed distance.

Upon rotation of the drive motor 1063 at this moment, the right side engage rods 1054 hold and travel with the envelope 40 leftwards from the position A to the position B.

Rotation of the fifth cam 1009 and operation of the air cylinder 1071 in combination advance and swing the pressor plate 1072 in order to press the envelope in the position B. Concurrently with this pressing, the air cylinder 1076 operates to urge the brush unit 1077 in order to fold over the flap 40*a* and seal the open mouth of the envelope 40 with the gummed tapes GT.

Next, the engage rods 1054 further travel to the position C with the sealed envelope 40, thereby pushing the preceding sealed envelope 40 to the position D, i.e. off the top face of the frame onto the receiver rods 1079 in a vertical state.

Thereupon, the air cylinder 1089 operates to turn the reserving straps 1088 forwards in order to lay the envelope 40 on the receiver rods 1979 in a horizontal state. After a prescribed number of envelopes 40 are reserved, the motor 1084 operates to advance the pusher 1081 in order to discharge the pile of sealed envelopes off the system.

In accordance with the apparatus of the present embodiment, sealing of the envelopes enclosing stockings can be carried out in a fully automatic fashion, thereby greatly saving manual labour and remarkably raising process efficiency.

Figure 30:
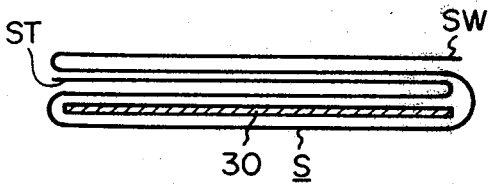
FIG. 30 is a shematic side view of the stockings folded around the insert in accordance with the first through fourth embodiment of the present invention.

In the case of the foregoing embodiments, the stockings S are folded around a cardboard insert 30 in the manner shown in FIG. 9H and the folded stockings S with the insert 30 takes the form shown in FIG. 30.

Workability in enclosing folded stockings in an envelope apparently depends on the stockings folded arounds the insert.

The folded condition of the stockings in the manner employed in the foregoing embodiment is shown in detail in FIG. 30. In the folded condition, the waist end SW of the stockings is in the uppermost layer of the folded body. Depending on the manner of folding, the welt or tow end ST may be placed in the uppermost layer of the folded body. In anyway, one of the ends of stockings is located in the uppermost layer of the folded body, in other words exposed outside the folded body as long as folding is performed in accordance with the manners of the foregoing embodiments. Presence of such an exposed end often greatly hinders smooth enclosing of the folded body, i.e. the folded stockings with the insert, into an envelope standing by.

It is the basic object of the fifth embodiment of this invention to provide a technique to fold stockings around each insert whilst folding in any end inside the folded body, thereby enabling smooth enclosing of the folded body into an envelope and greatly raising efficiency in enclosing work.

In accordance with the fifth embodiment, one section of stockings including one end is folded so that the end is located near one end is folded so that the end is located near one edge of an insert around which the other section of stockings including the other end is folded. Next, the first-named section is reverse folded on the second-named section.

Figure 31:
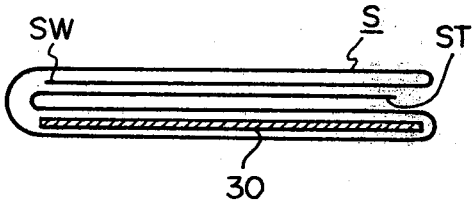
FIG. 31 is a like view of the stockings folded around the insert in accordance with the fifth embodiment of the present invention.

One example of the folded stockings in accordance with the present embodiment is shown in FIG. 31. It should be well noted that the waist end SW is located in the second layer and the tow end ST is located in the third layer of the folded body. It is also employable to place the toe end ST in the second layer and the waist end SW in the third layer of the folded body. Since, however, the waist end is a little wider in size than the toe end, it is rather preferable to employ the style shown in FIG. 31. The wider waist end on the upper side well covers the narrower toe end on the lower side when folded together.

Figure 32:
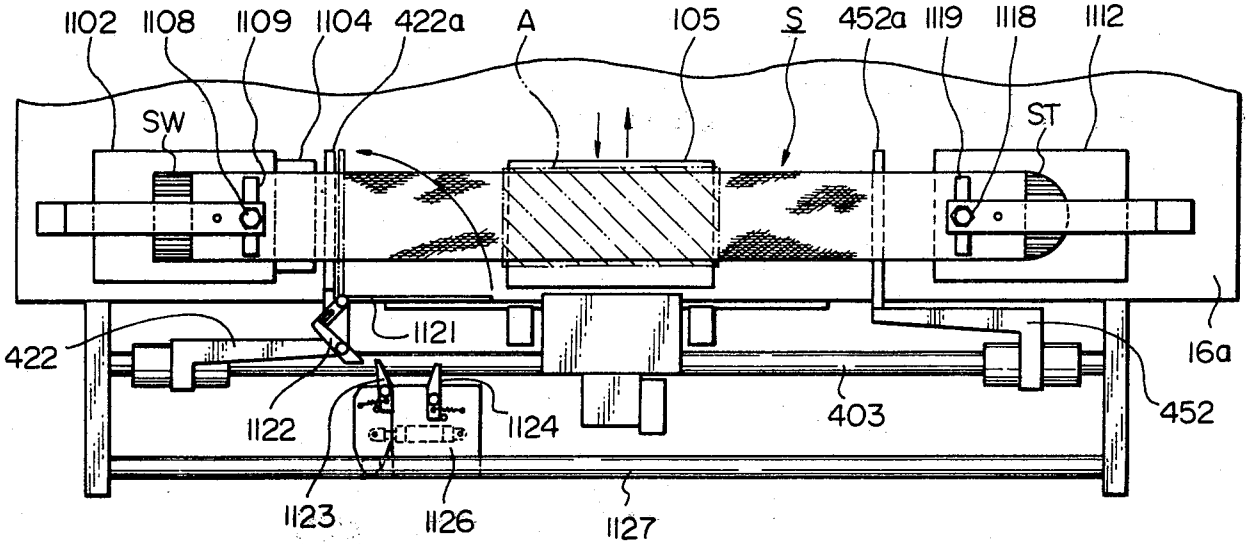
FIG. 32 is a top view of the above-described embodiment provided with an improved stockings folder assembly.
Figure 33A:
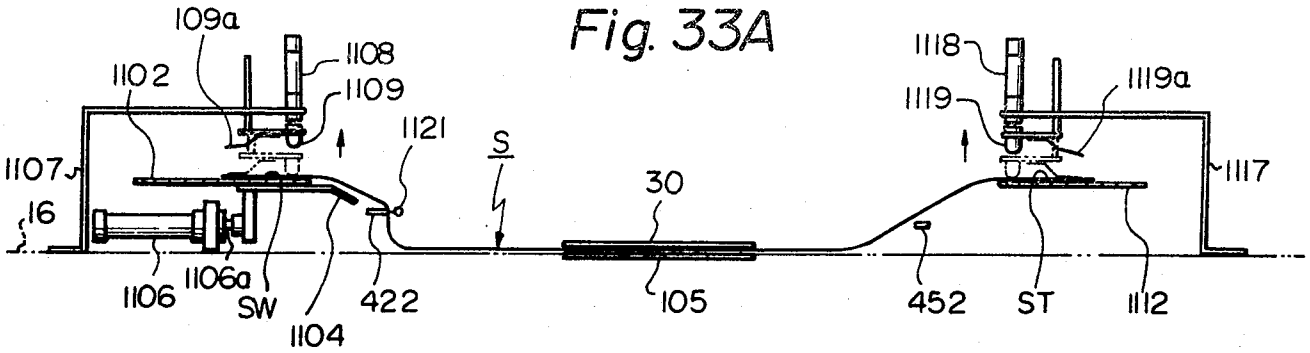
FIGS. 33A through 33C are front views for showing the operation in sequency of the fifth embodiment.

The apparatus for carrying out the above-described improved folding process is shown in FIGS. 32 and 33A.

A pair of fixed support plates 1102 and 1112 are arranged over the table 16 in the mounting station 16*a* on both sides of the transfer plate 105 of the transfer assembly 101. The folder bar 422 (452) having the folder rod 422*a* (452*a*) is slidable along the horizontal guide 403. Here, the folder rod 422*a* on the waist end side of the stockings is slightly higher in level than the folder rod 452*a* on the toe end side.

An end folder 1104 having a downwardly bent edge 1104*a* is arranged beneath the left side support plate 1102 and the free end of the edge 1104*a* is located above the left side folder rod 422*a*. An air cylinder 1106 is horizontally arranged on the table 16 and its piston rod 1106*a* is linked to the end folder 1104. A bracket 1107 extends overhead the support plate 1102 and vertically carried on air cylinder 1108. A pressor piece 1109 is coupled to the piston rod of the air cylinder 1108 and accompanied with a leaf spring 1109*a*.

Likewise, but in a symmetric arrangement, the right side support plate 1112 is accompanied with a bracket 1117, an air cylinder 1118 and a pressor piece 1119 with a leaf spring 1119*a*.

A swing lever 1121 is supported by an L-shaped holder 1122 pivoted to the left side folder bar 422. A pair of pawls 1123 and 1124 are arranged on a block 1126 mounted to a fixed bar 1127. The swing lever 1121 is swingable over 90 degrees from a position shown with solid lines to a position shown with chain lines in FIG. 32.

With the above-described construction, the operation proceeds as follows.

As shown in FIGS. 32 and 33A, stockings are placed in position with the middle on the transfer plate 105, the waist end SW on the left side and the toe end ST on the right side. Next, by operation of the transfer assembly 101, both ends SW and ST are located on the support plates 1102 and 1112, respectively, and held firmly thereon by the pressor pieces 1109, 1119 and leaf springs 1109*a*, 1119*a*. After the transfer plate 105 has returned to its initial position, the hold on the ends is cancelled in order to put the stockings in a free condition shown in FIG. 33A. Under this condition, the middle of the stockings S is located on the transfer plate 105 in its initial position, the waist end SW on the left side support plate 1102, and the toe end ST on the right side support plate 1112.

Next, the insert feeder assembly 201 operates to feed an insert 30 onto the middle of the stockings S. Concurrently with this process, the swing lever 1121 is driven for 90 degrees swing movement as shown with an arrow in FIG. 32.

Figure 33B:
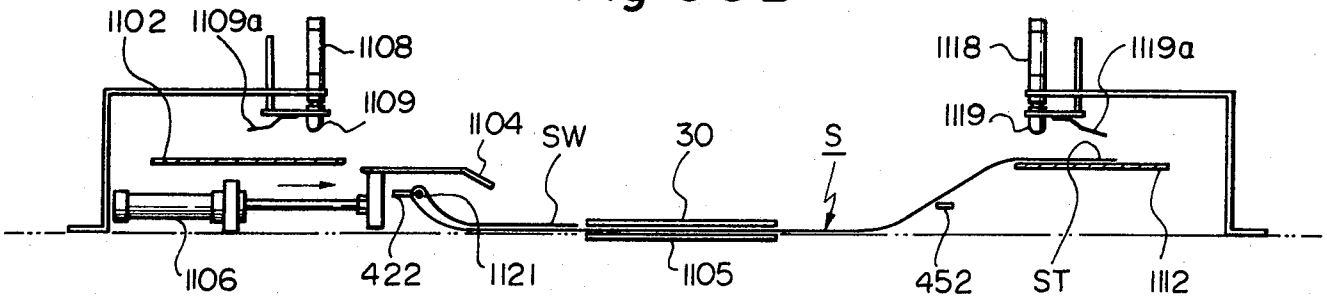

Then, the air cylinder 1106 operates to advance the end folder 1104 to the position shown in FIG. 33B in order to fold the section including the waist end SW at the position of the swing lever 1121 so that the waist end SW should be located close to the left side edge of the insert 30. This forms the first folded section.

Figure 33C:
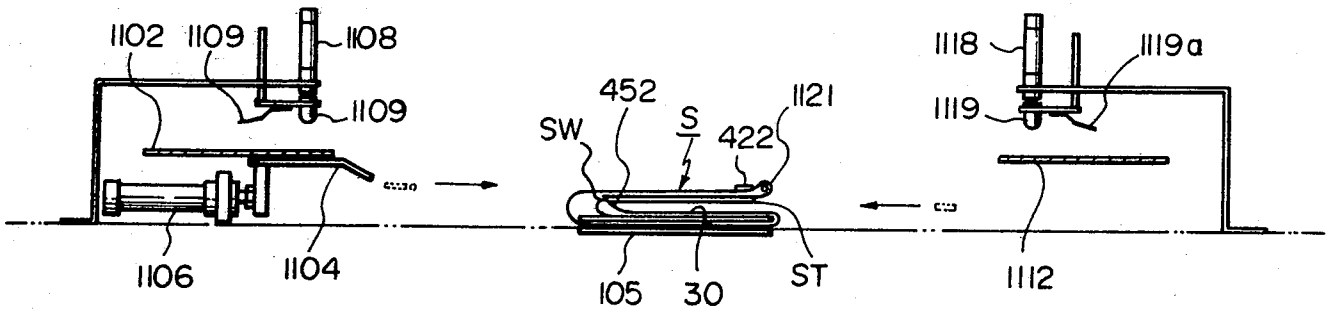

Thereafter, the pair of folder bars 422, 452 and the swing lever 1121 are brought to positions shown in FIG. 33C. As a consequence, movement of the right side folder bar 452 folds the section including the tow end ST around the insert 30. This forms the second folded section. Further, movement of the left side folder bar 422 folds the first folded section including the waist end SW over the second folded section including the two end ST. Thus a folded body such as shown in FIG. 31 is obtained.

As the transfer plate 105 moves rearwards as shown with one of the arrows in FIG. 32, the folded stockings S are disengaged from the folder bars 422, 452 and the swing lever 1121. The pawl 1124 return the swing lever 1121 to its initial position through its engagement with the holder 1122.

Since no end of stockings is exposed outside the folded body in accordance with the present embodiment, folded stockings can be very smoothly enclosed in envelopes without any hooking trouble at entrance. This leads to a great rise in efficiency in the enclosing work.

I claim:

1. A method for automatically packaging stockings using an apparatus having a setting station arranged adjacent one side of an operation table and an enclosing station arranged on said operation table at a position downstream to and substantially coplanar with said setting station, said method comprising the steps of receiving at said setting station a pair of stockings on a horizontal transfer plate of a transfer assembly arranged on said operation table and provided with a transfer gripping plate; delivering an insert from a supply thereof using an insert feeding assembly arranged on said operation table facing said setting station and feeding same onto said stockings at a position overlying said transfer plate; provisionally fixing at said setting station the position of said stockings and insert relative to said transfer plate using an insert gripping plate of an insert gripping assembly arranged adjacent to said transfer assembly; concurrently folding waist and toe end sections of said stockings around said insert being gripped by said insert gripping plate using a stockings folding assembly arranged on said operation table facing said setting station; feeding an envelope to said enclosing station using an envelope feeding assembly arranged on said operation table; transferring said stocking with said insert to a conveyor assembly by horizontally reciprocating said transfer assembly between said setting station and the upstream terminal of said conveyor assembly; conveying said stockings folded around said insert towards said enclosing station using said conveyor assembly arranged on said operation table and provided with a conveyor gripping plate; enclosing said stockings with said insert in said envelope using a stockings enclosing assembly arranged on said operation table facing said enclosing station and provided with an encloser for gripping said stockings folded around said insert; said step of transferring said stockings with said insert to said conveyor assembly is accomplished by said transfer gripping plate taking over the gripping of said stockings and insert from said insert gripping plate and said conveyor gripping plate taking over the gripping of said stockings and insert from said transfer gripping plate; and conveying said stockings and said insert to said stocking enclosing assembly by said encloser taking over the gripping of said stockings and insert from said conveyor gripping plate so that said stockings and insert are continuously gripped while being transferred from said setting station to said enclosing station.

2. The method for automatically packaging stockings as claimed in claim 1 wherein said insert is a foldable insert having a back cover section, a front cover section and an insert section bordered by first and second bending edges, and wherein said delivering an insert includes applying an air jet to said insert in order to flatten its back cover section, applying mechanical pressure to said second bending edge to separate said front cover section from said insert section, and opening said front cover section and said insert section into a position coextensive with said back cover section.

3. The method for automatically packaging stockings as claimed in claim 1 further comprising the step of sequentially feeding individual stockings to said setting station from a plurality of stockings reserved in a pile.

4. The method for automatically packaging stockings as claimed in claim 1 further comprising the step of sealing an open mouth of said envelope containing said stockings and insert with at least one gummed tape.

5. The method for automatically packaging stockings as claimed in claim 1 wherein said folding includes doubling one of said waist and toe end sections so that the associated end meets the associated edge of said insert, folding the other of said waist and toe end sections around said insert, and folding the doubled one section over the folded other section.

6. A two station apparatus for automatically packaging stockings comprising an operation table; a setting station arranged on said operation table adjacent one side thereof; an enclosing station arranged on said operation table at a position downstream to and substantially coplanar with said setting station; a transfer assembly arranged on said operation table and provided with a transfer gripping plate and a horizontal transfer plate, said transfer plate for receiving a pair of stockings thereon at said setting station; an insert feeding assembly arranged on said operation table facing said setting station for delivering an insert from a supply thereof and feeding same onto said stockings at a position overlying said transfer plate; an insert gripping assembly arranged adjacent to said transfer assembly and provided with an insert gripping plate for provisionally fixing the position of said stockings and insert relative to said transfer plate while positioned at said setting station; a stockings folding assembly arranged on said operation table facing said setting station for concurrently folding waist and toe end sections of said stockings around said insert being gripped by said insert gripping plate; an envelope feeding assembly arranged on said operation table for feeding an envelope to said enclosing station; a conveyor assembly arranged on said operation table and provided with a conveyor gripping plate, said conveyor assembly having means for conveying said stockings folded around said insert towards said enclosing station; a stockings enclosing assembly arranged on said operation table facing said enclosing station and provided with an encloser for gripping said stockings folded around said insert, said stockings enclosing assembly having means for enclosing said stockings with said insert in said envelope; and means for horizontally reciprocating said transfer assembly between said setting station and the upstream terminal of said conveyor assembly for transferring said stockings with said insert to said conveyor assembly by said transfer gripping plate taking over the gripping of said stockings and insert from said insert gripping plate and said conveyor gripping plate taking over the gripping of said stockings and insert from said transfer gripping plate, said conveying assembly conveying said stockings and said insert to said stocking enclosing assembly by said encloser taking over the gripping of said stockings and insert from said conveyor gripping plate so that said stockings and insert are continuously gripped while being transferred from said setting station to said enclosing station.

7. The apparatus for automatically packaging stockings as claimed in claim 6 wherein said insert feeding assembly includes an insert reservoir containing a plurality of inserts in face-to-face juxtaposed fashion and provided with means for constantly pushing said inserts towards its delivery terminal, a separator mechanism arranged relative to said delivery terminal of said insert reservoir, and pneumatic means for separating the foremost insert from the succeeding inserts in said reservoir.

8. The apparatus for automatically packaging stockings as claimed in claim 6 wherein said insert is a foldable insert having a back cover section, a front cover section and an insert section bordered by first and second bending edges, and wherein said insert feeding assembly includes an insert reservoir containing a plurality of inserts in face-to-face juxtaposed fashion and provided with means for constantly pushing said inserts towards its delivery terminal, an opener mechanism arranged relative to said delivery terminal of said insert reservoir, means for applying an air jet to the foremost insert in order to flatten its back cover section, means for applying mechanical pressure to said second bending edge to separate said front cover section from said insert section, means for opening said front cover section and insert section into a position coextensive with said back cover section, a feeder mechanism arranged in front of said insert reservoir and in cooperation with said opener mechanism for feeding said foremost insert in an open state to a prescribed stand-by position, and a catcher mechanism for shifting the open insert from said stand-by position to the middle of said stockings held by said transfer assembly at said setting station.

9. The apparatus for automatically packaging stockings as claimed in claim 6 further comprising a stockings feeder assembly for feeding stockings from a source to said setting station, said stockings feeder assembly including a mounting station at said source arranged in front of said setting station wherein a plurality of stockings are stored in a pile, and a feed plate reciprocal between said mounting station and said setting station while carrying individual stockings manually taken from said pile.

10. The apparatus for automatically packaging stockings as claimed in claim 6 further comprising an envelope sealing assembly arranged downstream of said stockings enclosing assembly for sealing a flap adjacent an open mouth of said envelope containing said stockings and insert with at least one gummed tape.

11. The apparatus for automatically packaging stockings as claimed in claim 10 wherein said envelope sealing assembly includes a conveyor belt arranged for carrying said envelope containing said stockings and said insert therein, a reversing plate arranged next to the downstream end of said conveyor belt, means for tilting said envelope falling down from said conveyor belt into a horizontal position when the presence of an envelope on said reversing plate is detected, means for intermittently delivering at least a strand of gummed tape from a source, a cutter annexed to said intermittent delivering means for cutting said gummed tape into prescribed length, means for applying the cut gummed tape to said flap of said envelope, and means for folding down said flap over the body of said envelope to seal its open mouth with said cut gummed tape.

12. The apparatus for automatically packaging stockings as claimed in claim 6 in which said stockings folding assembly includes means for doubling one of said waist and toe end sections so that the associated end meets the associated edge of said insert, means for folding the other of said waist and toe end sections around said insert, and means for folding the doubled one section over the folded other section.

* * * * *